United States Patent [19]

Matumura et al.

[11] 4,182,249

[45] Jan. 8, 1980

[54] AUTOMATIC BUTTONHOLE APPARATUS FOR USE WITH SEWING MACHINE

[75] Inventors: Nobuyoshi Matumura, Yao; Kotohiko Tukioka, Kobe, both of Japan

[73] Assignee: Maruzen Sewing Machine Co., Ltd., Moriguchi, Japan

[21] Appl. No.: 908,911

[22] Filed: May 24, 1978

[30] Foreign Application Priority Data

Jun. 13, 1977 [JP] Japan ..... 52/70276
Nov. 29, 1977 [JP] Japan ..... 52/144353

[51] Int. Cl.[2] ..... D05B 3/06; D05B 3/02
[52] U.S. Cl. ..... 112/158 B; 112/158 E
[58] Field of Search ..... 112/158 B, 65–67, 112/158 E, 272, 277, 235, 130, 275

[56] References Cited

U.S. PATENT DOCUMENTS

| | | | |
|---|---|---|---|
| 3,596,618 | 8/1971 | Goldbach | 112/158 B |
| 4,016,821 | 4/1977 | Minalga | 112/65 X |
| 4,019,449 | 4/1977 | Hauf | 112/158 B |
| 4,056,070 | 11/1977 | Hauf | 112/158 B |

*Primary Examiner*—Werner H. Schroeder

*Assistant Examiner*—Andrew M. Falik

*Attorney, Agent, or Firm*—Arnstein, Gluck, Weitzenfeld & Minow

[57] ABSTRACT

A presser bar has a presser attachment for holding fabric placed on a machine bed and a shoe is attached to the presser attachment in such a manner as to be slidable in the fabric feed direction. A first slidable variable resistor is fixed to a lateral surface of the shoe, with its slider connected to the presser bar so as to be displaced. A recess is formed in the machine arm or bed at a certain position and a second slidable variable resistor is mounted in the recess, with its slider projecting therethrough. This slider of the second variable resistor is adapted to be displaced, for example, by a button inserted in the recess and confined between the slider and a wall of the recess. The first variable resistor provides a voltage substantially corresponding to the amount of fabric feed, while the second variable resistor provides a voltage corresponding to the button size. Thus, the length of the buttonhole to be stitched is determined by comparing the fabric feed related voltage with the button size related voltage.

16 Claims, 23 Drawing Figures

| | BIGHT POSITION | | FEED AMOUNT | |
|---|---|---|---|---|
| STITCH | $\overline{Q1}$ | Q1 | $\overline{Q1}$ | Q1 |
| 1 | 1 | 10 | 0 | 0 |
| 2 | 10 | 1 | 0 | 0 |
| 3 | 1 | 10 | 0 | 0 |
| 4 | 10 | 1 | 0 | 0 |
| 5 | 1 | 10 | 0 | 0 |
| 6 | 10 | 1 | 1 | -1 |
| 7 | 9 | 2 | 1 | -1 |

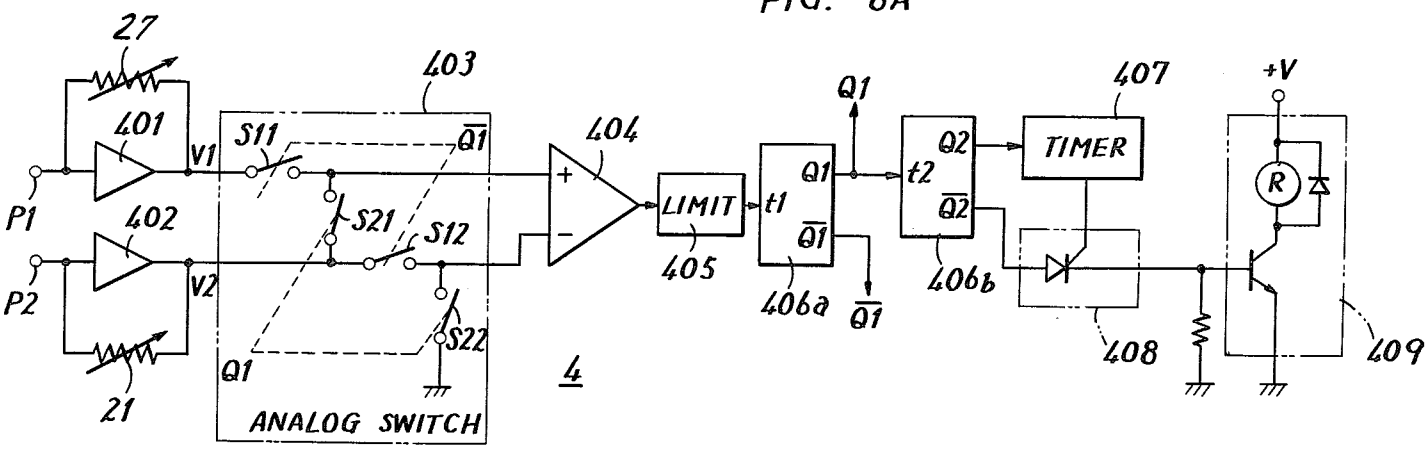
FIG. 8A
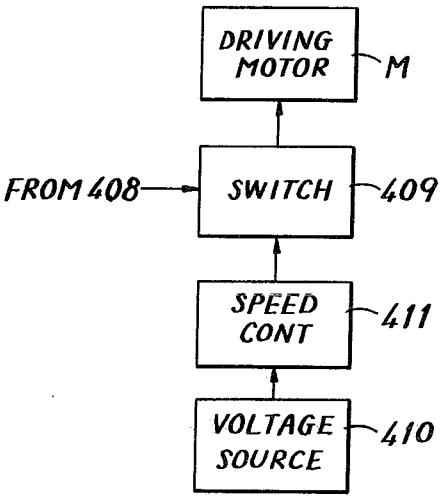
FIG. 8B
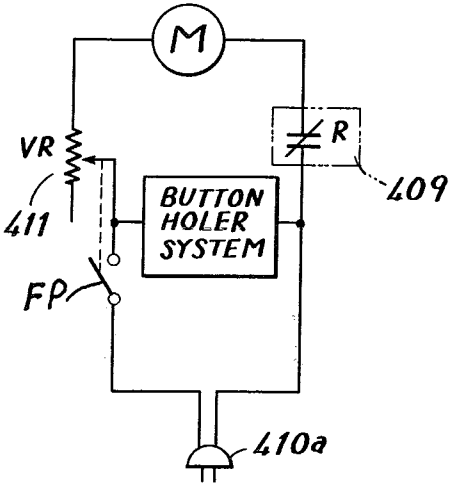

AUTOMATIC BUTTONHOLE APPARATUS FOR USE WITH SEWING MACHINE

BACKGROUND OF THE INVENTION

1. Field of the Invention

The present invention relates to an automatic buttonholer or buttonhole apparatus for use with a sewing machine and particularly, it relates to an automatic buttonholer designed to automatically determine the buttonhole size when the buttonhole is being stitched by a zigzag sewing machine.

2. Description of the Prior Art

In recent years, a sewing machine designed to oscillate its needle right and left for zigzag sewing has been put into practical use. Further, it has been proposed that such zigzag sewing machine be designed so that it is capable of stitching buttonholes. FIG. 1 shows an example of a buttonhole which forms the background of the present invention and which can be stitched by applying the present invention. Bar tacks BT1 and BT2 are formed at opposite ends of a buttonhole BH formed in cloth. Zigzag sewing or stitching having a predetermined amplitude l is applied to the left side SD1 and right side SD2 of the buttonhole BH. In this manner, the sewing of the buttonhole is performed.

In the sewing of such buttonhole shown in FIG. 1, it is necessary that its length L correspond with the size of a button to be inserted in the buttonhole BH. Heretofore, adjustments in machine operation, according to button hole size, have been made manually. However, in view of the troublesome nature of such manual operation, lately, it has been also proposed to replace manual operation by automatic operation. In an example of such automatic system, a cloth presser or shoe is provided with a button size sensing lever, the movement of which is transmitted to a buttonhole cam block by mechanical transmission means, e.g., a link mechanism. With the cam block connected to a cam shaft, the bar tacks BT1 and BT2 are sewn, whereupon the cam block is automatically separated from the cam shaft by the sensing lever and the left side SD1 and right side SD2 are then sewn.

However, in a conventional zigzag sewing machine of interest to the present invention, as described above, the presence of the link mechanism for transmitting the movement of the sensing lever which senses the button size results in a connection error or interference. Further, since it is necessary to directly transmit the movement of this lever to thereby switch the connection between the buttonhole cam block and the cam shaft, the switching position tends to be unstable and hence there has been a disadvantage that the resulting buttonholes are of uneven size. Further, in such systems having such a mechanical sensing lever, it is essential that the shoe and the sensing lever be integrally connected together so as to cause the sensing lever to follow the movement of the shoe. As a result, the shoe and the related parts become not only complicated in construction but also larger in size. Besides this, since the sensing lever is necessarily located near the area where the sewing needle operates, there has been a disadvantage that the sewing is troublesome; for example, the visual range is limited.

SUMMARY OF THE INVENTION

In brief, the present invention provides an automatic buttonholer for use with a sewing machine, comprising a motor energized by a power source, speed control means for controlling the energization of the motor, a sewing mechanism contained in the machine arm and driven by the motor, a sewing needle vertically displaceably installed below the machine arm, a presser bar disposed near the sewing needle below the machine arm and having attached to the front end thereof a presser attachment for holding cloth placed on the machine bed, a shoe mounted to the presser attachment in such a manner as to be slidable in the cloth feed direction, means generating an electric signal associated with the amount of movement of the shoe, means generating an electric signal associated with the size of a buttonhole to be sewn, means for comparing the two electric signals, and switch means adapted to act on the sewing mechanism when the two electric signals coincide with each other.

According to a preferred embodiment of the invention, the sewing mechanism includes a feed mechanism and a bight mechanism, and the buttonhole sewing operation is divided into a plurality of steps. Further, it comprises a static memory for storing successive feed information and bight information for the steps, pulse generating means for generating timing pulses in synchronism with the rotation of a main shaft, counter means for counting the timing pulses and successively addressing the static memory, and means reading feed information and bight information from the addressed memory for controlling the feed mechanism and bight mechanism, the coincidence signal being used to control the static memory.

Accordingly, a principal object of the present invention is to provide an automatic buttonholer for use with a sewing machine, wherein the buttonhole size adaptation is attained electrically rather than mechanically.

Another object of the present invention is to provide an automatic buttonholer for use with a sewing machine, which dispenses with the sensing lever, thereby simplifying or minimizing the mechanism around the shoe.

A further object of the present invention is to provide an automatic buttonholer for use with a sewing machine, which is capable of positionally separating the button size setting section and the section for detecting the buttonhole size, i.e., the amount of cloth feed.

Still another object of the present invention is to provide an automatic buttonholer for use with a sewing machine, wherein the button size setting section can be disposed at any desired position, providing satisfactory operability.

A further object of the present invention is to provide an automatic buttonholer for use with a sewing machine, which has an optimum construction and provides a satisfactory stabilized operation.

These and other objects, features, aspects and advantages of the present invention will become more apparent from the following detailed description of the present invention when taken in conjunction with the accompanying drawings.

BRIEF DESCRIPTION OF THE DRAWINGS

FIG. 8A is a detailed circuit diagram showing an embodiment of a buttonholer control circuit according to the present invention.

FIG. 8B is a schematic block diagram showing the relation between the buttonhole system, motor and foot controller in the embodiment shown in FIG. 8A.

FIGS. 14A through 14D show the mode conditions in the embodiment of FIGS. 12A through 12C wherein FIG. 14A shows the upper bar tack sewing condition, FIG. 14B shows the left side sewing condition, FIG. 14C shows the lower bar tack sewing condition, and FIG. 14D shows the right side sewing condition.

DESCRIPTION OF THE PREFERRED EMBODIMENTS

Figure 2A:
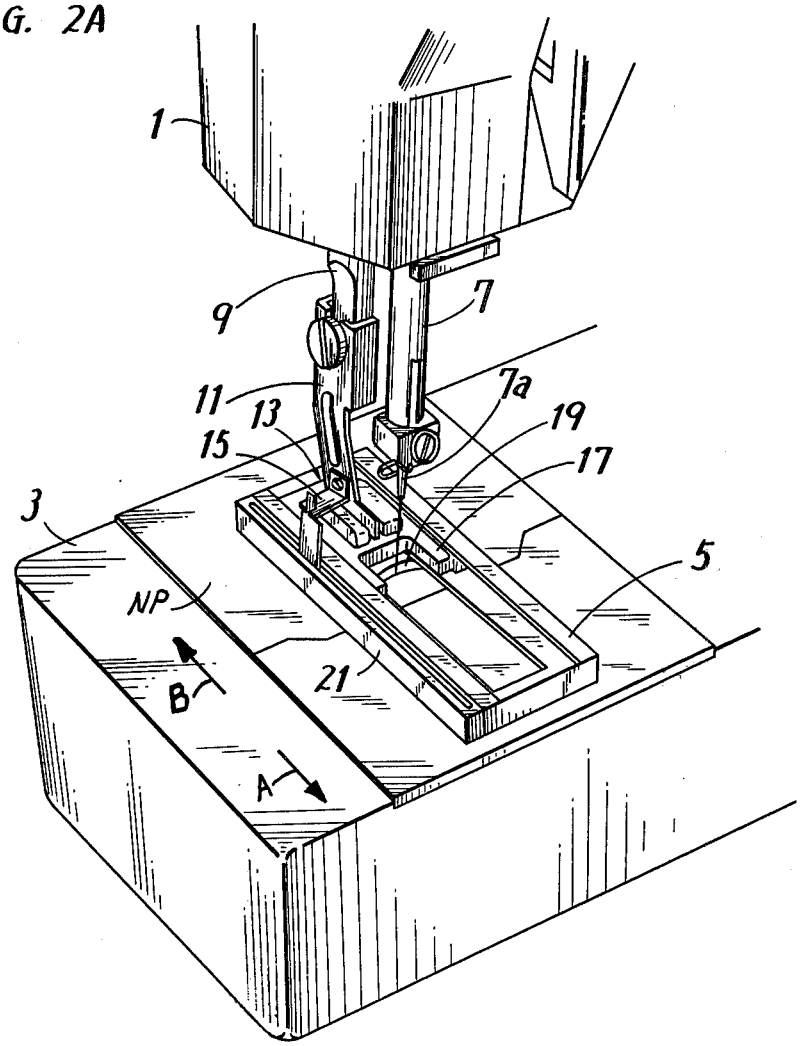
FIG. 2A is a perspective view of the principal portion of a preferred embodiment of a button hole size detecting section (cloth feed amount detecting section) used in the present invention.
Figure 2B:
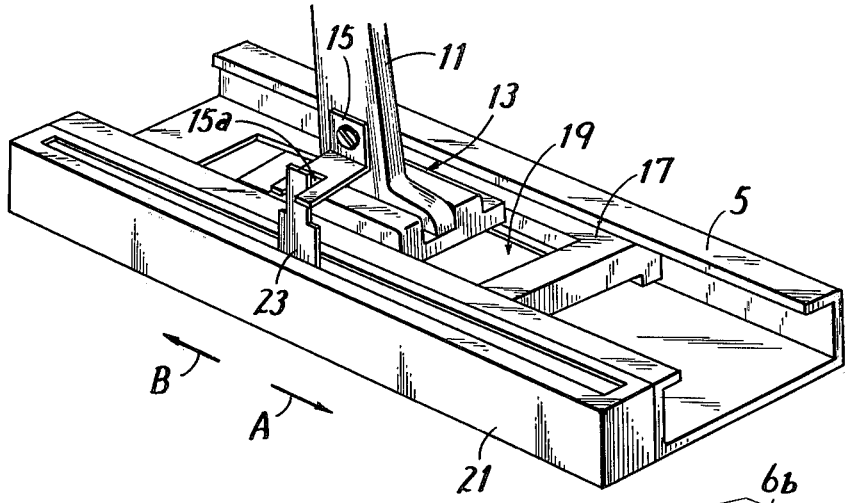
FIG. 2B is an enlarged perspective view of the same.

Referring to FIGS. 2A and 2B, a cloth holding means used in the present invention will now be described. This cloth holding means includes a shoe 5 of substantially U-shaped cross-section having a groove for slidably receiving a presser foot 17 to be later described, and a presser attachment 13. The presser attachment 13 comprises a shank 11 fixed to the front end of a presser bar 9 attached to the lower front end portion of a sewing machine arm 1, and the presser foot 17 made, e.g., of plastic, and pivotally connected to the shank 11, said presser 17 being slidably inserted in the groove of the shoe 5, as described above. The lower front end portion of the sewing machine arm 1 is provided with a needle bar 7 having a sewing needle **7*a* attached to the front end thereof. Positioned on a sewing machine bed 3 and under the shoe 5 is a needle plate NP having a needle hole 19 through which the sewing needle 7*a* passes. As can be clearly understood by reference to the enlarged view in FIG. 2B, a sliding variable resistor 21 is fixed to a lateral surface of the shoe 5. The slider 23 of the sliding variable resistor 21 is fitted in a notch 15*a* formed in a lug 15. Therefore, when the shoe 5 is moved in the directions of arrows A or B, the sliding variable resistor 21 and the slider are relatively displaced, so that an analog voltage whose value corresponds to the movement is derived from the resistor 23. In this embodiment, a voltage value V2 from this resistor 21** corresponding to the amount of cloth feed is utilized.

Figure 3:
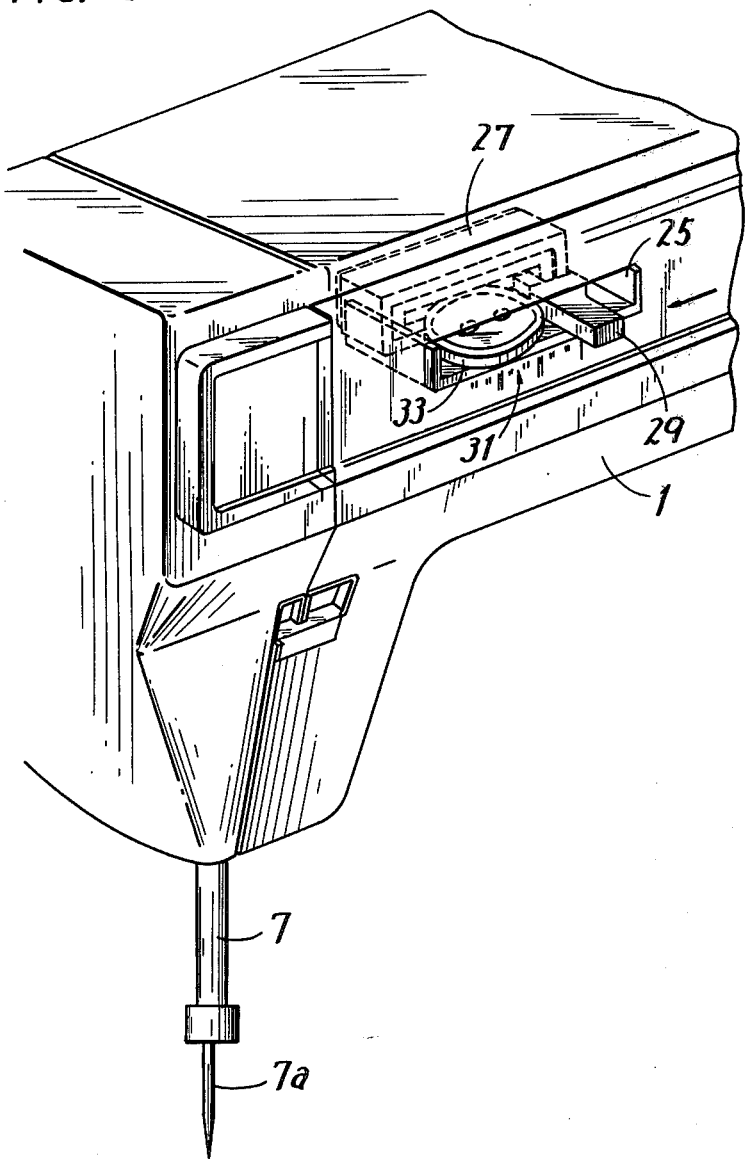
FIG. 3 is a perspective view of the principal portion of a preferred embodiment of a button size sensing means used in the present invention.

Referring to FIG. 3, a button size sensing apparatus used in the present invention will now be described. Though not shown, the sewing machine arm 1 contains a main shaft 35 or upper shaft connected to a motor. The needle bar 7 is connected to the upper shaft 35 through a crank mechanism 37. Therefore, the energization of the motor effects vertical reciprocating movement of the needle bar 7 together with the sewing needle **7*a*. Further, the front surface of the arm 1 is formed with a recess 25 in which a sliding variable resistor 27 is set, as shown in broken lines in FIG. 3. The slider 29 of the variable resistor 27 is provided with a knob projecting beyond the front surface of the arm 1. Further, the arm 1 is provided with a scale 31 indicating button sizes over the slide range of the slider 29. A button 33, which is used to determine the buttonhole size is interposed between one end of the bore 25 and the slider 29, or the slider 29 may be set at a predetermined position on the scale 31, whereby a voltage whose value corresponds to the button size is generated from the sliding variable resistor 27**. In this embodiment, a voltage V1 corresponding to the button size is utilized.

Figure 4:
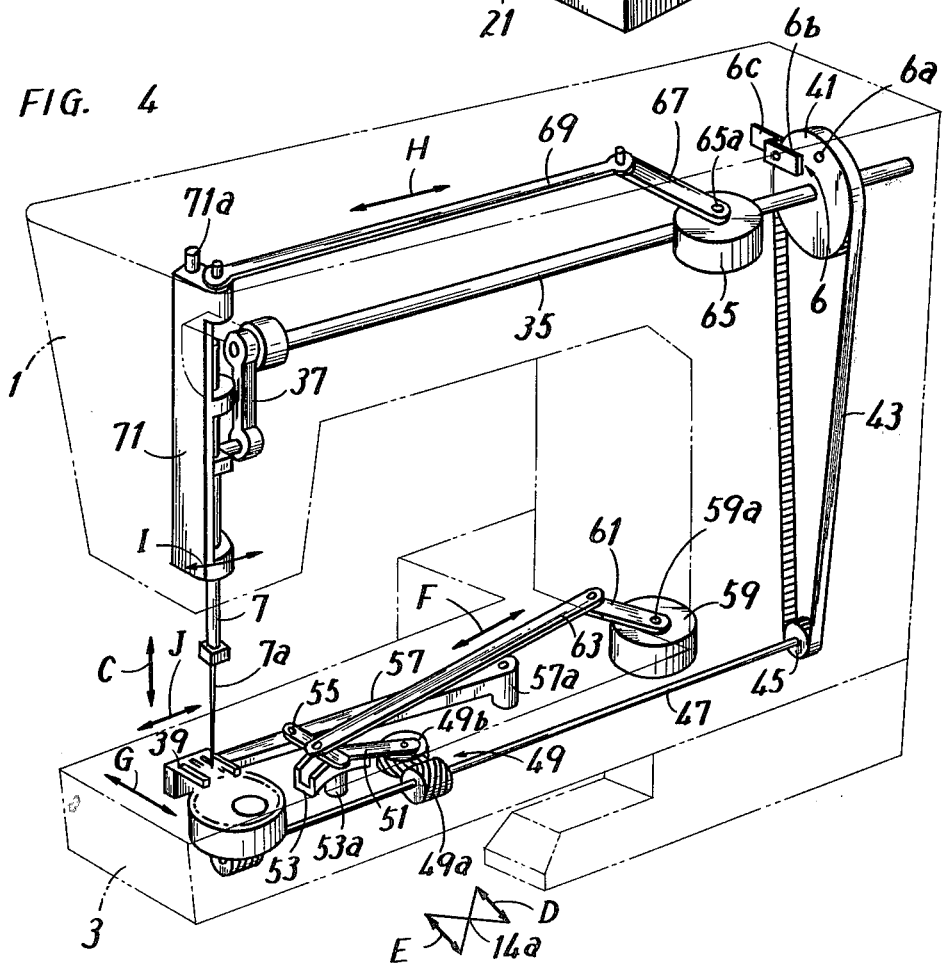
FIG. 4 is a perspective view, more or less diagrammatic, of the principal mechanism of a zigzag sewing machine including a buttonhole section to which the present invention is applicable.

FIG. 4 shows the principal portion of a zigzag sewing machine to which the present invention is applied. Below the sewing machine bed 3 or inside of a bracket arm 1, a driving motor, not shown but indicated by the character M in FIG. 8B is mounted. The rotation of this driving motor is transmitted, at a predetermined speed reduction ratio, to a main upper shaft 35 inside the bracket arm 1. As is known in the art, the upper shaft 35 is connected to the various mechanisms of the sewing machine.

Connected to the upper shaft 35 is a crank 37 for reciprocating the needle bar 7 and together with the sewing needle **7*a* in the directions of arrows C. Disposed in registration with the sewing needle 7*a*, on the bed 3, is a feed dog 39** for feeding fabric to be sewn in the directions of arrows G.

Mounted inside the bed 3 is a lower shaft 47 for driving the feed dog 39. A timing pulley 41 fixed on the upper shaft 35 and a reduced timing pulley 45 fixed on the lower shaft 47 are interconnected by a timing belt 43. As the upper shaft 35 is rotated, the lower shaft 47 is rotated at double the speed of the upper shaft. A gear wheel **49*a* of a pair of spiral gears 49 is fixed on the lower shaft 47. The other gear 49*b* in the pair 49 is rotatably supported on a shaft, not shown, inside the bed 3. Rotation of the lower shaft 47 effects rotation of the gear 49*b*. A pin is eccentrically positioned on the upper surface of the gear 49*b* and is connected to one end of a connecting lever 51. The other end of the connecting lever 51 is connected to one end of a feed regulator 53**.

The feed regulator 53 is arcuate and is pivotally supported on a shaft **53*a* disposed at the middle of the arc. The regulator 53 has a U-shaped guide groove in which is slidably inserted a slide block (not shown) depending from the lower surface of a slide plate 55. The other end of the slide plate 55 is attached to a feed bar 57 which is rotatably connected at one end thereof to the bed 3 and fixed at the other end to the feed dog 39. The slide plate 55 is attached at its midpoint to one end of a lever 63. An arm 61 is fixed at one end on the rotary shaft 59***a* of a direct current motor 59, and the other end of the lever 63 is pivotally connected to the other end of the connecting arm 61. The motor 59 serves as a feed control motor.

The machine arm 1 contains a direct current motor 65 for bight control. Fixed to the rotary shaft 65*a* of the motor 65 is one end of an arm 67, the other end of which is pivotally connected to one end of a pitman 69. The other end of the pitman is pivotally connected to a gate 71 which is supported by a shaft 71*a* so as to be swingable in the direction of arrow I. The movement of the gate 71 causes the needle bar 7 to be oscillated in the direction of arrow J.

The operation of the arrangement constructed in the manner described above will now be described to the extent needed for the understanding of the present invention.

Initially, the power is turned on. In response thereto, the driving motor, not shown, is energized to rotate the upper shaft 35. The rotation of the upper shaft 35 is converted into a linear reciprocating motion by the crank mechanism 37, so that the needle bar 7 together with the sewing needle 7*a* are reciprocated in the direction of arrow between the upper and lower dead points. The rotation of the upper shaft 35 effects rotation of the timing pulley 41, which is transmitted to the timing pulley 45 by the timing belt 43 so that the lower shaft 47 is rotated. As a result, the gear 49*b* is rotated, causing the feed regulator 53 to oscillate in the directions of arrows D and E around the axis of the shaft 53*a*. In this case, the amplitude of the oscillation of the feed regulator 53 increases as the slide block approaches the opposite ends of the guide groove. When the slide block is at the center of the guide groove, the feed regulator does not oscillate. The position of the slide plate 55 relative to the feed regulator 53 determines the amount of displacement of the feed bar 57 and of the feed dog 39 in the directions of arrows G. If, therefore, the angle of rotation of the direct current motor 59 is controlled to move the connecting lever 63 in the directions of arrows F, then the amount of movement of the feed dog 39 is controlled so as to control the fabric feed. In this case, if the slide plate 55 is positioned to the right of the axis of shaft 53*a* (the arrow D side) the feed is forward, while if it is positioned to the left of this axis (the arrow E side), the feed is backward.

Further, when the direct current motor 65 is rotated through a certain angle, the pitman 69 is moved in the directions of arrows H thereby rocking gate 71 in the directions of arrows I. The needle bar 7 and needle 7*a* are swung in the direction of arrow J, thereby achieving zigzag sewing. The amplitude of movement of the sewing needle 7*a* (bight) is controlled by controlling the angle of rotation of the direct current motor 65.

Accordingly, in this embodiment, by controlling the angles of rotation of the direct current motors 59 and 65 according to a buttonhole to be sewn, the feed (arrow G) and bight (arrow J) are controlled.

Figure 5:
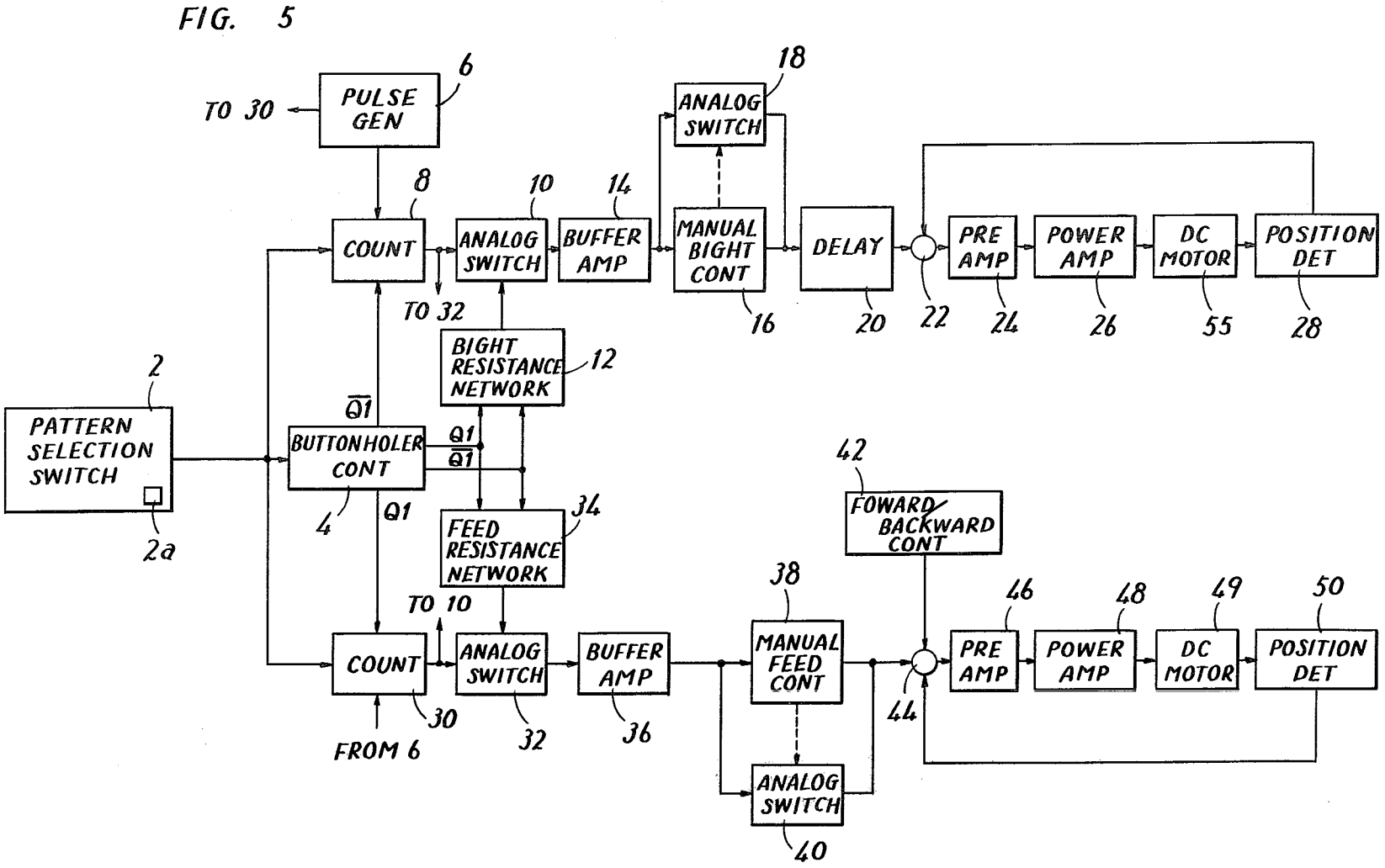
FIG. 5 is a block diagram showing an example of a control circuit for controlling the sewing machine shown in FIG. 4.

FIG. 5 is a block diagram of one embodiment of a control circuit for controlling the sewing machine illustrated in FIG. 4. The embodiment shown has been adapted for sewing a buttonhole as well as a plurality of different kinds of patterns. To that end, a pattern selection switch 2 is provided. The pattern selection switch 2 may comprise a keyboard switch which includes key switches, not shown, associated with the respective patterns and a key switch 2*a* for a buttonhole. Upon selecting operation of the key switch 2*a*, a command signal associated with the buttonhole is obtained and is applied to a buttonholer control circuit 4. The buttonholer control circuit 4 is responsive to the selection signal from the buttonhole selection switch 2*a* to actuate a counter 8 or 30.

A pulse generator 6 includes a magnet 6*a* which is partially embedded in the side surface of the pulley 41, a proximity switch 6*b*, a lead switch, or the like mounted on a bracket 6*c* fixed on arm 1 in association with said magnet 6*a* to provide a Hall effect. Accordingly, the proximity switch 6*b* serves to generate one pulse per revolution of the shaft 35, i.e. one pulse for each downward movement of the needle 7*a*. It is pointed out that since the pulse generator 6 may be of any type that generates one timing pulse for each downward movement of the needle, any other types such as a photoelectric switch, a microswitch or the like may be utilized. The timing pulse from the pulse generator 6 is applied to the counter 8 or 30 as a count pulse which is activated responsive to the selection signal from the key switch 2*a*.

A bight resistance network 12 and a feed resistance network 34, each comprising a group of series connected resistors, one for each sewing step of a buttonhole, will be more fully described subsequently with reference to FIGS. 6A and 6B. Said resistance networks are supplied with a voltage at both ends thereof, such that a voltage associated with a coordinate position for each one step is obtained through resistance division. The outputs from the counters 8 and 30 are obtained for each count value and applied to analog switches 10 and 32, respectively. The analog switches 10 and 32 each comprises a number of switching devices, which number corresponds to the number of downward movements of the needle of one cycle of the step, such that these are correspondingly turned on by the counters 8 and 30. Accordingly, a voltage developed in the bight resistance network is obtained from the analog switch 10 as an output voltage corresponding to the coordinate position, i.e. a bight amount of each stitch. On the other hand, the analog switch 32 provides an output voltage corresponding to he coordinate position or the feed amount of each stitch of the step from the feed resistance network 34.

The bight associated voltage from the analog switch 10 is applied through a buffer amplifier 14 to a manually operable bight control circuit 16 and an analog switch 18. On the other hand, the feed associated voltage from the analog switch 32 is applied through a buffer amplifier 36 to a manually operable feed control circuit 38 and an analog switch 40.

The analog switches 18 and 40 are conduction controlled and responsive to the control circuits 16 and 38, respectively, whereby the bight voltage and the feed voltage, as adjusted, are obtained.

The bight voltage from the analog switch 18 is applied to an adder 22 a delay circuit 20. The feed voltage, as adjusted, from the analog switch 40 is applied to an adder 44. The delay circuit 20 functions to delay the bight voltage with respect to the feed voltage and, accordingly, the input bight voltage is delayed by a certain time interval when applied to the adder 22. The adder 44 for feed also is supplied with a control voltage from a manually operable forward/backward control circuit 42. The forward/backward control circuit 42 serves to control the forward and backward stitches of a buttonhole, automatic reverse stitching pattern, and the like through manual operation.

The adder 22 receives a feedback voltage from a position detector 28 and adds to it the bight voltage from the delay circuit 20 to provide a total voltage to a preamplifier 25. Similarly, the adder 44 adds to the feedback voltage from a position detector 50, the feedback voltage from the analog switch 40 and the control voltage from the above described forward/backward control circuit 42 to provide a total voltage to a preamplifier 56. It is pointed out that the adder 22, the preamplifier 24, a power amplifier 26, a direct current motor 55 and the position detector 28 constitute a bight displacing means for controlling displacment of the bight mechanism. It is further noted that the adder 44, the preamplifier 46, a power amplifier 48, a direct current motor 49 and the position detector 50 constitute a controlling means for controlling displacement of the feed mechanism.

Figure 6A:
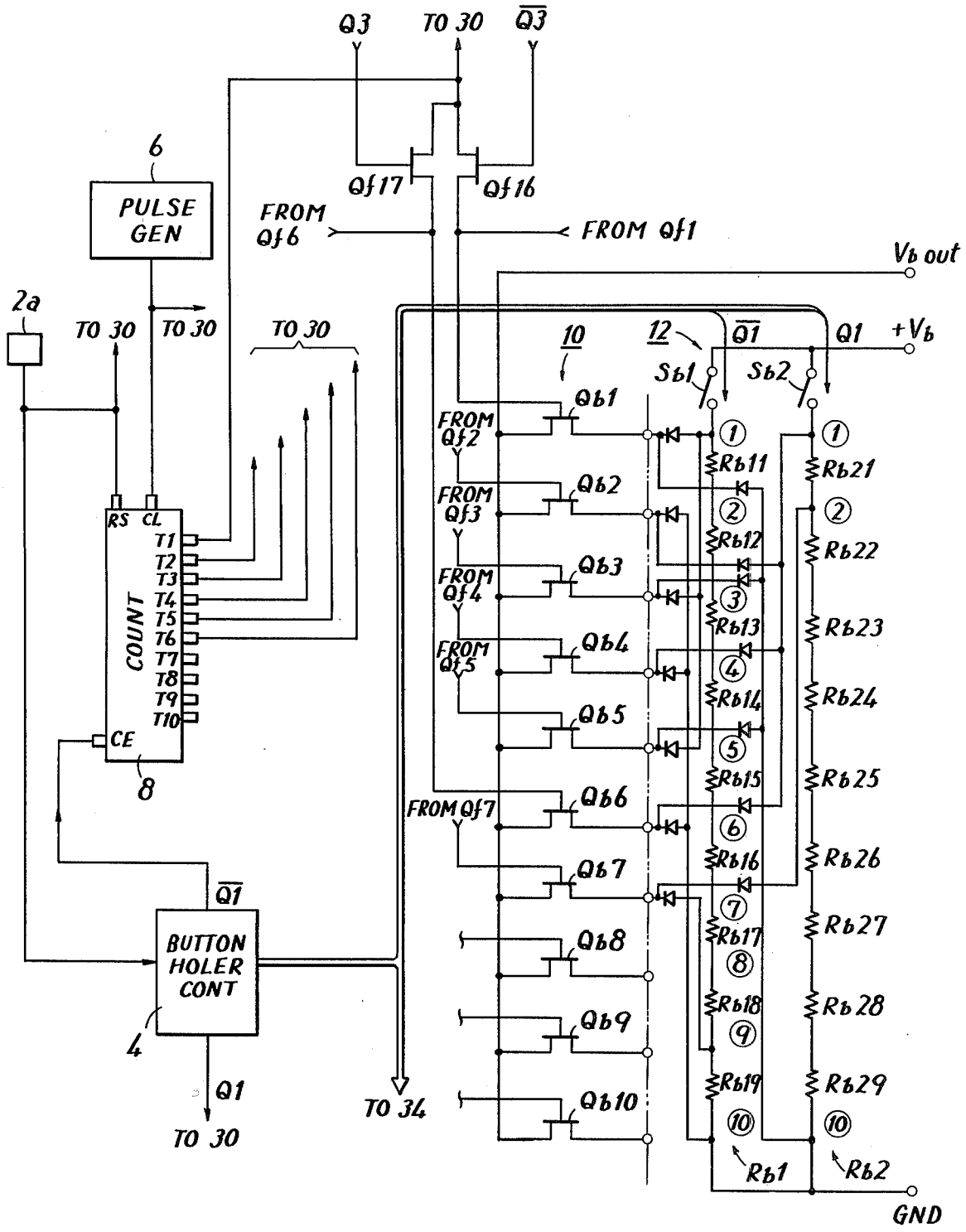
FIGS. 6A and 6B are detailed circuit diagrams showing the principal portion of FIG. 5.

FIG. 6A shows a schematic diagram of a major portion of the FIG. 5 embodiment. It is pointed out that FIG. 6A specifically depicts the bight resistance network 12, the analog switch 10 and the counter 8 in FIG. 5. The feedback resistance network 34, the analog switch 32 and the counter 30 are specifically depicted in FIG. 6B. Since the bight resistance network 12 and the feed resistance network 34 have substantially the same circuit configuration, only the bight resistance network 12 and the circuit portions associated therewith will be described, and a detailed description of the feedback resistance network 34 and the portions associated therewith will be omitted.

The bight resistance network 12 comprises two resistor circuits Rb1 and Rb3 in association with two steps. The resistor circuit Rb1 comprises, for example, a series connection of nine resistors Rb11 through Rb19 so as to provide ten graded voltages. Similarly, the resistor circuit Rb2 also comprises a series connection of resistors Rb21 through Rb29. The number of resistors and their resistance values to be series connected in the resistor circuits Rb1 and Rb2 are determined in relation to the number of the coordinate positions included in the different steps of a buttonhole to be sewn. One end of each of the resistor circuits Rb1 is commonly connected to a voltage source +Vb through the corresponding switches Sb1 and Sb2. The other end of each of the resistor circuits Rb1 and Rb2 is commonly grounded. The above described switches Sb1 and Sb2 are actuated in response to control signals Q1 and $\overline{Q1}$, respectively, from the buttonhole control circuit 4 hereinafter to be described.

The analog switch 10 comprises feed effect transistors Qb1 through Qb10, each serving as a switching device. The number of switching devices included in the analog switch 10 is determined in relation to the required number of downward movements of the needle. The embodiment is shown as including ten switching devices. The gate electrodes, i.e. control electrodes, of the respective switching devices Qb1 through Qb10 are individually connected to the respective output terminals T1 through T10 of the counter 8 or 30. Accordingly, the switching devices Qb1 through Qb10 are individually actuated in response to the outputs T1 through T10, respectively, of the counter 8 or 30. The source electrodes, i.e. the output electrodes of these switching devices Qb1 through Qb10 are commonly connected to the output bight voltage terminal Vbout. The input electrodes, of these switching devices Qb1 through Qb10 are selectively connected to appropriate junctions of the series connections in the respective resistor circuits Rb1 and Rb2.

The respective junctions of the switching devices Qb1 through Qb10 of the analog switch 10 will be described in greater detail with reference to a specific example shown in FIG. 7A.

Figures 7A, 7B:
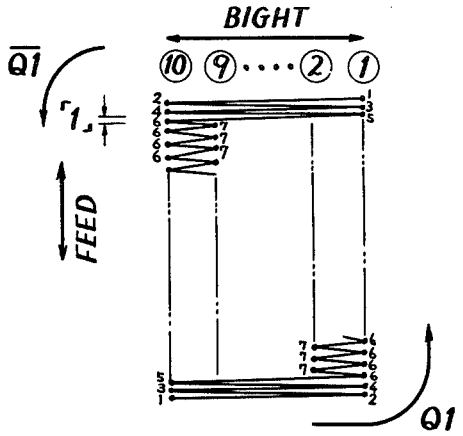
FIG. 7A is a diagrammatic view showing the buttonhole sewing steps or modes.
FIG. 7B is a diagram showing the bight position and feed position for the successive stitches in the respective modes.

FIG. 7A is a view showing one example of a buttonhole to be sewn, wherein the ordinate direction denotes a feed or fabric travel distance, while the abscissa denotes a bight or an amplitude. FIG. 7B shows data concerning positional information of the bight and feed in relation to a buttonhole. The bight is set in terms of the absolute coordinate position and, in the case of the pattern example shown, the maximum amplitude has been equally divided by nine. The feed is set in terms of relative displacement and, in the pattern example shown, the minimum travel, i.e. the absolute travel from the sixth stitch to the seventh stitch, is assumed to be unity.

In the mode $\overline{Q1}$, the bight is "1" at the upper right, as viewed in the figure, in the first stitch. Since the feed remains stationary unless there is movement, the feed is "0". In the second stitch in the mode $\overline{Q1}$, the coordinate position of the bight moves to "10" and the feed remains in the same position as the first stitch and is "0", although in the figure a slight shift is shown. Similarly, the positional data of the bight and feed from the third stitch to the seventh stitch in the mode Q1 can be shown as a numerical value shown in the column Q1 in FIG. 7B.

In the mode Q1, the bight in the first stitch is "10" in the lower left, as viewed in the figure. Since the feed remains in a stationary state, the feed is "0". In the second stitch of the mode Q1, the coordinate position of the bight moves to "1" and the feed is in the same position as the first stitch, i.e. the feed is "0". Similarly, the positional data of the bight and feed of the third stitch to the seventh stitch in the mode Q1 may be shown as the numerical value appearing in the column Q1 in FIG. 7B.

Figure 6B:
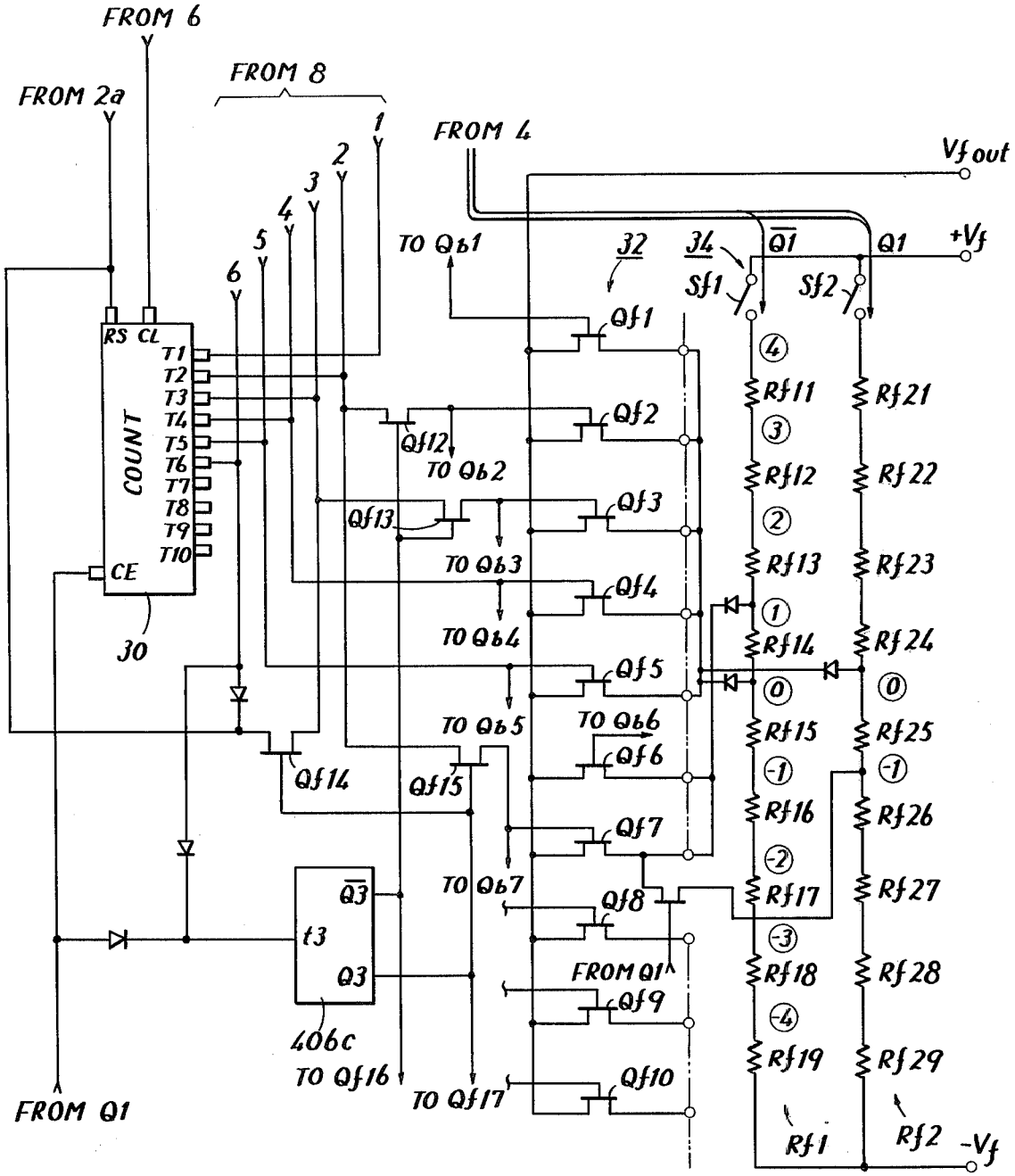

Following is a description of the relation between the resistor circuits Rb1 and Rf1 and Rf2 in FIGS. 6A and 6B and the analog switches 10 and 32, based on the example shown in FIG. 7A. In the pattern example shown in FIG. 7A, the bight in the first stitch in the mode $\overline{Q1}$ is "1" and the feed in the first stitch in the mode $\overline{Q1}$ is "0". Thus, the input electrode of the switching device Qb1 of the analog switch 10 is connected to the junction 1 of the corresponding resistor circuit Rb1 and the input electrode of the switching device Qf1 of the analog switch 32 is connected to the junction 0 of the resistor circuit f1. In the second stitch, in mode $\overline{Q1}$, the bight is "10" and the feed is "0". Thus, the input electrode of the switching device Qb2 of the analog switch 10 is connected to the junction 10 of the resistor circuit Rb1 and the input electrode of the switching device Qf2 of the analog switch 32 is connected to the junction 0 of the corresponding resistor circuit Rf1. In the third stitch in the mode $\overline{Q1}$, the feed amount is the same as that in the second stitch and is "0" while the bight is in the position of "1". Accordingly, the input electrode of the switching device Qb3 of the analog switch 10 is connected to the junction 1 of the resistor circuit Rb1 and the input electrode of the switching device Qf3 of the analog switch 22 is connected to the junction 0. Similarly, in the fourth stitch in the mode $\overline{Q1}$, the bight is the same as that in the second stitch and is "10", while the feed is "0". In the fifth stitch, the bight is "1" and the feed is "0", since the feed is in the same position as the fourth stitch. In the sixth stitch, the bight is "10" and the feed is "1", while in the seventh or final stitch, in the pattern example shown, the bight is "9" while the feed is forward similar to the sixth stitch and "+1". Accordingly, the respective input electrodes of the switching devices Qb4 through Qb7 of the analog switch 10 and the switching devices Qf4 through Qf7 of the analog switch 39 are connected, as shown in FIGS. 6A and 6B.

In the mode Q1, in the first stitch, the bight is "10" and the feed is "0". Thus, the input electrode of the switching device Qb1 of the analog switch 10 is connected to the junction 10 of the corresponding resistor circuit Rb2 and the input electrode of the switching device Qf1 of the analog switch 32 is connected to the junction 0 of the corresponding resistor circuit Rf2. In the second stitch of mode Q1, the bight is the same as the first stitch and is "1" and the feed is "0". Accordingly, the input electrode of the switching device Qb2 of the analog switch 10 is connected to the junction 1 of the resistor circuit Rb2 and the input electrode of the switching device Qf2 of the analog switch 32 is connected to the junction 0 of the corresponding resistor circuit Rf2. In the third stitch in mode Q1, the feed amount is the same as that of the second stitch and is "0", while the bight is in the position of "10". Accordingly, the input electrode of the switching device Qb3 of the analog switch 10 is connected to the junction 10 of the resistor circuit Rb2 while the input electrode of the switch device Qf3 of the analog switch 32 is connected to the junction 0.

Similarly, in the fourth stitch in mode Q1, the bight is the same as that of the second stitch and is "1", while the feed is "0". In the fifth stitch, the bight is "10" and the feed is "0", inasmuch as the feed is in the same position as that of the fourth stitch. In the sixth stitch, the bight is "1" and the feed is the rearward "−1". In the seventh or final stitch, in the pattern example shown, the bight is "2" and the feed is rearward like the sixth stitch and is "−1". Accordingly, the input electrodes of the switching devices Qb4 through Qb7 of the analog switch 10 and the switching devices Qf4 through Qf7 of the analog switch 39 are connected, as shown in FIGS. 6A and 6B.

FIG. 8A is a block diagram of a preferred embodiment of the buttonholder control circuit 4. The circuit 4 is activated in response to a signal from the switch 2a of the pattern selection switch 2. The terminals P1 and P2 are each supplied with a reference voltage from respective voltage sources, not shown. The terminal P1 is connected to one input terminal of an analog switch 403 through a parallel circuit of the sliding variable resistor 27 and a preamplifier 401 in which the resistor 22 serves as a feedback element. The terminal P2 is connected to the other input terminal of the analog switch 403 through a parallel circuit of the sliding variable resistor 21 and a preamplifier 402 in which the resistor 21 serves as a feedback element. Accordingly, one input terminal of the analog switch 403 is supplied with the voltage V1 related to a particular button size, while the other input terminal of the analog switch 403 is supplied with the voltage V2 related to the fabric feed. The analog switch 403 constitutes a conductor for the voltage V1 through a switch S11 and a conductor for the voltage V2 through a switch S12. A switch S21 is connected between the output side of the switch S11 of one conductor and the input side of the switch S12 of the other conductor. The output side of the switch S12 of the other conductor is grounded through a switch S22. The switches S11 and S12 are activated in gang fashion in response to the output of the mode $\overline{Q1}$, i.e. the output $\overline{Q1}$ of a flip-flop circuit 406a, hereinafter to be described, and the switches S21 and S22 are activated in a gang fashion in response to the output of mode Q1 of the flip-flop circuit 406a.

The output voltages V1 and V2 from the analog switch 403 are applied to the plus input terminal and the minus input terminal of a comparator 404. The comparator 404 serves to compare both voltages V1 and V2 and to provide a voltage output. The output of the comparator 404 is applied to a triggering input t1 of a first flip-flop circuit 406a through a limiter 405 having a wave shaping function. The flip-flop circuit 406a is inverted from the storing state each time a triggering input t1 is received. A non-inverted output Q1 and an inverted output $\overline{Q1}$ are applied as the signals of the mode Q1 and $\overline{Q1}$, respectively, to the analog switch 403, the counter 8 or 30, the bight resistance network 12 and the feed resistance network 34. At the same time, the output Q1 of the flip-flop circuit 406a is commonly applied to a triggering input t2 of a second flip-flop circuit 406b. Similar to the flip-flop circuit 406a, the flip-flop circuit 406b also is responsive to a triggering input t2 for inversion from the storing state. The non-inverted output Q2 of the flip-flop circuit 406b is applied to a switch circuit 409 through a timer 407 while the inverted output $\overline{Q2}$ is applied to the switch circuit 409 through a switching device 408 which functions as a thyristor. The timer 407 comprises an RC circuit and serves to maintain the high level output for a short time period, such as a few seconds, even after the output Q2 becomes a low level output. The flip-flop circuits 406a and 406b and a flip-flop circuit 406c, hereinafter to be described, have been so designed that the inverted outputs $\overline{Q1}$, $\overline{Q2}$ and $\overline{Q3}$ are of high level in the initial condition. As shown in FIG. 8b the voltage source 410 is applied to the switch circuit 409 through a speed control circuit 411 which includes a foot operated control pedal FP and a variable resistor 411 ganged with the foot pedal. The switch circuit 409 is activated when the switching control input from the switching device 408 is at low level, thereby to provide a voltage to driving motor M which is phase controlled by the speed control circuit 411.

Now that the circuit configuration of the preferred embodiment has been described, a description of the operation of the embodiment will follow. In case of a buttonhole, the slider 29 of the variable resistor 27 shown in FIG. 3 is adjusted to the button size being sewn, based on the button 33 or a graduation 31. At the same time, the shoe 5 shown in FIGS. 2A and 2B is adjusted to the initial position. Then, the switch 2a of the pattern selection switch 2 shown in FIG. 5 is depressed. Accordingly, the buttonhole control circuit 4 shown in FIG. 8A is activated. Then the foot pedal FP is depressed, so that the switch circuit 409 is activated to turn on the power supply to energize the driving motor M to rotate the upper shaft 35.

In such a situation, the voltage V1, as seen in FIG. 8A, is adjusted to a value corresponding to the button size and the voltage V2 is zero. The flip-flop circuit 406a is in its initial condition and, therefore, the output $\overline{Q1}$ representative of mode $\overline{Q1}$ is at high level. Accordingly, the switches S11 and S12 of the analog switch 403 are activated and two input terminals of the comparator 404 are supplied with the voltages V1 and V2. Two voltages are in the relation V1>V2, and, therefore, the output of the comparator 404 remains at high level. The output $\overline{Q1}$ of the flip-flop circuit 406*a* causes the series resistor circuits Rb1 and Rf1 of the bight resistance network 12 and the feed resistance network, shown in FIGS. 6A and 6B, to be selected or to be activated. Since the high level of the output $\overline{Q1}$ of the flip-flop circuit 406*a* is connected to the terminal CE of the counter 8, the counter 8 is disabled or rendered ineffective. On the other hand, the terminal CE of the counter 32 is supplied with the low level output Q1 and, accordingly, the counter 30 is activated or rendered effective.

The first pulse obtained from the pulse generator 6 is in timed relation to the movement of needle 7*a* as it moves upwardly from the lower dead point to the upper dead point, as seen in FIGS. 2A and 4, as the upper shaft 35 is rotated. Accordingly, the counter 30 effects a counting operation of the pulse to provide the output T1. This output T1 is applied to the switching device Qf1, included in the analog switch 32, through the analog switching device Qf16, the gate electrode or the control electrode which is supplied with the output $\overline{Q3}$ from the flip-flop circuit 406*c*, whereby the switching device Qf1 is activated. As a result, the voltage from the junction ⓪ of the resistor circuit Rf1 is obtained at the output voltage terminal Vfout conducted through the switching device Qf1. Since the voltage is that which represents the feed "0", the direct current motor 59 shown in FIGS. 4 and 5 is not rotated. Accordingly, the feed dog 39 shown in FIG. 4 does not feed a fabric sheet. At the same time, the switching device Qb1 of the analog switch 10 is activated. Accordingly, the voltage representative of the bight amount "1" from the junction ① of the resistor circuit Rb is obtained at the bight voltage terminal Vbout through the switching device Qb1. Now, the direct current motor 65 shown in FIGS. 4 and 5 is rotated responsive to said voltage and the needle bar support 71 is rocked, so that the needle 7*a* is swung in the direction of the arrows J. Concurrently, the needle 7*a* descends to the position of the first stitch of the mode Q1 shown in FIG. 7A.

The upper shaft 35 is further rotated and the second pulse is generated by the pulse generator 6. Accordingly, the output T2 is obtained from the counter 30 to cause the switching device Qf2 of the analog switch 32 to be activated through the analog switching device Qf12 that is supplied with the output $\overline{Q3}$ of the flip-flop circuit 406*c*. The voltage from the junction ⓪ of the resistor circuit Rf1 is obtained at the output terminal of Vfout of the analog switch 32. At the same time, the switching device Qb2 of the analog switch 10 is activated. Accordingly, the voltage from the junction ⑩ of the resistor circuit Rb1 is obtained at the output terminal Vbout through the switching device Qb2. As a result, the direct current motor 55 is energized whereby the bight width is determined. Thus, the feed voltage and the bight voltage associated with the stitch are obtained in response to the pulse signal for each stitch from the pulse generator 6. As a result, the motor 59 which controls the feed and the motor 65 which controls the bight are energized, so that the prescribed feed amount and the bight width are achieved. Thus, the output T6 is obtained from the counter 30, when the sixth pulse is generated by the pulse generator 6. The output T6 resets the counter 38 to the initial state. In this operation, the flip-flop circuit 406*c* is reversed from the state responsive to a triggering signal of the output T6, so that the output $\overline{Q3}$ becomes the low level and the output Q3 becomes the high level. Therefore, the switching devices Qf12 and Qf13 are deactivated and the switching devices Qf14 and Qf15 are activated. Additionally, the switching device Qf16 is activated and the switching device Qf17 is deactivated. The above described operation represents termination of the bar tack portion BT1 shown in FIG. 1. It will be understood that the count number associated with these pulses, i.e. needle number in the bar tack portion BT1 may be set, as desired.

The counter 30 is reset in response to the sixth pulse and at the same time provides the second output signal T'1. The output T'1 is applied to the switching devices Qf6 and Qb6 through the switching device Qf17 which has been supplied with the output Q3 of the flip-flop circuit 406*c* at its gate electrode. Thereafter, when the seventh pulse is received, the counter 30 provides the second output signal T'2. This output T'2 is applied to the switching devices Qf7 and Qb7 through the switching device Qb15. When the eighth pulse is further generated, the counter 30 provides the second output signal T'3 which is applied through the switching device Qf14 which has been supplied with the output Q3 at its gate electrode thereof, so that the counter 30 is again reset to the original state, thereby to provide the third output signal T''1. The output signal T'1 is applied to the switching devices Qf6 and Qb6. The above described operation is repeated and the sewing operation for the left side portion SD1 of the buttonhole continues. Accordingly, the shoe 5 moves successively in a forward direction, while the voltage V2 from the sliding variable resistor 21 gradually increases. When the difference between voltages V1 and V2 becomes zero, i.e. the voltages V1 and V2 are equal to each other, the comparator 404 provides a displacement output.

Figure 1:
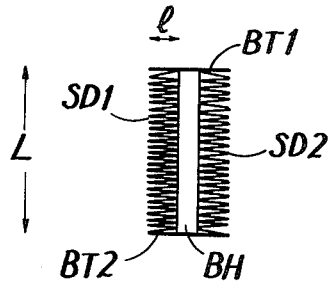
FIG. 1 is a diagrammatic view of an example of a buttonhole which forms the background of the present invention and which can be sewn in accordance with the present invention.

When the output from the comparator 404 is displaced, the flip-flop circuit 406*a* receiving the output from the comparator 404 through the limiter 405 is triggered, so that the flip-flop circuit 406*a* is reversed from the storing state, with the result that the output Q1 becomes the high level while the output $\overline{Q1}$ becomes the low level. When the output Q1 becomes the high level the switches S11 and S12 of the anlog switch 403 are deactivated, while the switches S21 and S22 of the analog switch 403 are activated. Accordingly, the minus input of the comparator 404 is supplied with ground potential, i.e. the zero potential, while the plug input of the comparator 404 is supplied with the voltage V2 from the sliding variable resistor 21. At the same time, the counter 30 is deactivated and the counter 8 is activated. The flip-flop circuit 406*c* is reversed from the storing state to regain the original state, with the result that the output $\overline{Q3}$ becomes the high level, while the output Q3 becomes the low level. The resistor series circuits Rb2 and Rf2 of the bight resistance network 12 and the feed resistance network 34, respectively, are selected. Thus, the switching of modes $\overline{Q1}$ and Q1, shown in FIG. 7A, is achieved and, thereafter, the bar tack portion BT2 and the right side portion SD2 of the buttonhole shown in FIG. 1 are sewn.

Since the output Q1 becomes the high level, the flip-flop circuit 406*b* is reversed from the storing state, with the result that the output Q2 now is at high level and the output $\overline{Q2}$ is at low level. Accordingly, the switching device 408 is activated in response to the output from the timer 407. However, since the output $\overline{Q2}$ is at low level, the switch circuit 409 is not deactivated, with the result that the motor M continues to rotate.

After the mode is switched, the first pulse is obtained from the timing pulse generator 6 and the counter 8 repeats the same operation as that of the counter 30. More specifically, the counter 8 counts the number of the above described pulse to provide the output T1. Accordingly, the switching device Qf1 included in the analog switch 32 is activated and the voltage from the junction ⓪ of the resistor circuit Rf2 is obtained at the output voltage terminal Vfout through the switching device Qf1. At the same time, the switching device Qb1 of the analog switch 10 is activated. Accordingly, the voltage, corresponding to the bight amount "10" at the junction ⑩ of the resistor circuit Rb2 is available at the bight voltage terminal Vbout, through the switching device Qb1. The needle 7*a* descends to the first stitch position of mode Q1, in the example shown in FIG. 7A. The upper shaft 35 is further rotated and the second pulse of mode Q1 is generated from the pulse generator 6. Accordingly, the output T2 is obtained from the counter 8, and the switching device Qf2 of the analog switch 32 is activated. The voltage obtainable from the junction ⓪ of the resistor circuit Rf2 is available at the output terminal Vfout of the analog switch 32. At the same time, the switching device Qb2 of the analog switch 10 is activated. The voltage obtainable from the junction ① of the resistor circuit Rb2 is available at the output terminal Vbout through the switching device Qb2. When the sixth pulse is generated from the pulse counter 6, the output T6 is obtained from counter 8. Counter 8 is reset to its original state responsive to the output T6 and the flip-flop circuit 406*c* is reversed from the storing state, with the result that the output $\overline{Q3}$ now is at low level while the output Q3 is at high level. Accordingly, the switching devices Qf12, Qf13 and Qf16 are deactivated, while the switching devices Qf14, Qf15 and Qf17 are activated. After the above described operation, the bar tack portion BT2 shown in FIG. 1 is completed.

The counter 8 is reset in response to the above described sixth pulse and at the same time a second output signal T'1 is obtained. The output T'1 is applied to the switching devices Qf6 and Qb6 through the switching device Qf17. When the seventh pulse is received, the counter 8 provides the second output signal T'2, which is applied, through the switching device Qf15, to the switching devices Qf7 and Qb7. Thereafter, the eighth pulse is received and the counter 27 provides the second output signal T'3. At the same time, the counter in response thereto, through the switching device Qf14, is reset again to its initial state, thereby providing the third output signal T''1. The right side portion SD2 of the buttonhole is stitched through repetition of the above described steps. The shoe 5 now moves in a rearward direction and the voltage from the sliding variable resistor 21 is gradually reduced. When the voltage V2 reaches zero, i.e. both inputs to the comparator 404, a displacement output is obtained from the comparator 404.

When the output from the comparator 404 is displaced, the flip-flop circuit 406*a*, in response to the displacement of the output through the limiter 405 is triggered, so that the flip-flop circuit 406*a* is reversed from the storing state, with the result that the output $\overline{Q1}$ is now at high level while the output Q1 is at low level. When the output Q1 of the flip-flop circuit 406*a* is at low level, the flip-flop circuit 406*b* which is reversed from the storing state, is triggered in response to the output Q1, with the result that the output $\overline{Q2}$ of the flip-flop circuit 406*b* now is at high level while the output Q2 of the flip-flop circuit 406*b* is at low level. Although the output Q2 of the flip-flop circuit 406*b* is at low level, the output from the timer circuit 407 continues to be at high level, for a short time period, as a function of the timing operation of the timer 407. Since the output $\overline{Q2}$ is at high level while the switching device 408 is activated, the high level output is obtained from the switch 408. Therefore, the switch circuit 409 is activated and the driving motor M is brought to a stop and maintained in arrested condition. Thus, the sewing operation of a buttonhole is automatically accomplished. Thereafter, the foot controlled pedal is released, and the circuit is reset to its initial state.

Although the switching circuit 409 has been implemented by a relay, in the embodiment shown, it should be understood that any suitable means which can perform the function of circuit 409 may be utilized. It is further pointed out that while a sliding resistor is utilized for setting the button size in the embodiment shown, any suitable arrangement may be provided, in any location, without being limited to the embodiment shown.

Figure 9:
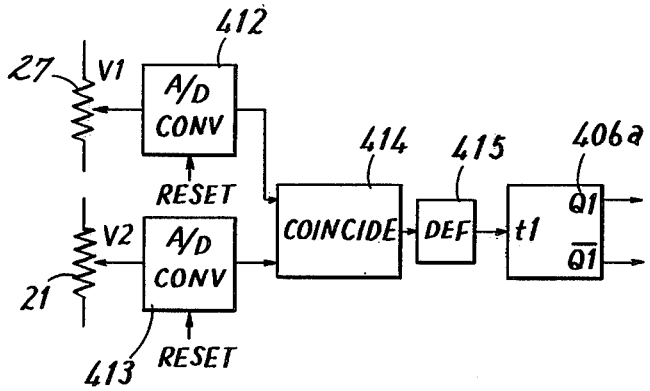
FIG. 9 is a block diagram showing another embodiment of the present invention.

FIG. 9 illustrates another embodiment of the present invention. It is pointed out that the FIG. 9 embodiment is substantially the same as the FIG. 8A embodiment, except for certain modifications, hereinafter to be described. More specifically, the voltage V2, proportional to the fabric feed obtainable from the above described sliding variable resistor 21, is converted into a digital signal by means of an analog/digital converter 413, and the digital signal, thus obtained, is applied to one input terminal of a coincidence circuit 414. On the other hand, the voltage V1, obtainable from a sliding variable resistor or a potentiometer 65 for setting the above described button size, is converted into a digital signal by means of a similar analog/digital converter 412 and the digital signal, thus obtained, is applied to the other input terminal of the coincidence circuit 414. This coincidence circuit 414 serves to compare the contents in the two analog/digital converters 412 and 413 and to provide a high level pulse, if and when both, coincide with each other. The output from the coincidence circuit 414 is applied to a differentiation circuit 415 for differentiating the rise of the pulse, above described, and the output from the differentation circuit 415 is applied to the input terminal t1 of a triggerable flip-flop circuit 406*a*, as shown in FIG. 8A. The outputs Q1 and $\overline{Q1}$ of the flip-flop circuit 406*a* are utilized for accomplishing the controlling operation, above described.

Figure 10:
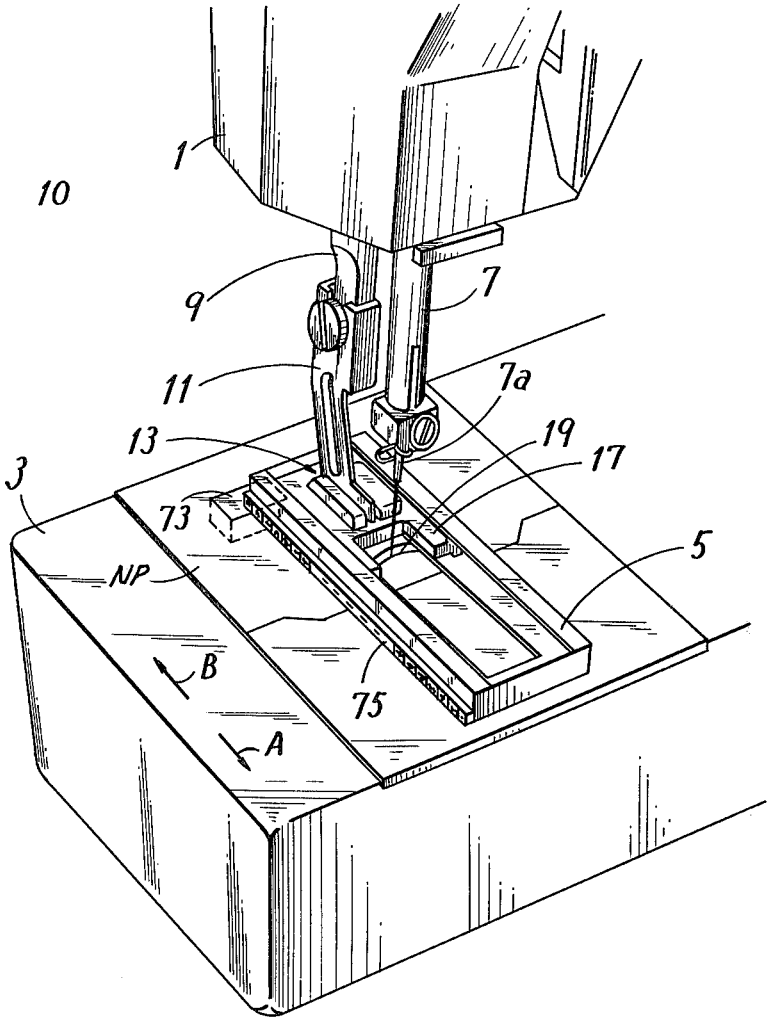
FIG. 10 is a perspective view of the principal portion of another embodiment of a buttonhole size sensing means used in the present invention.
Figure 11:
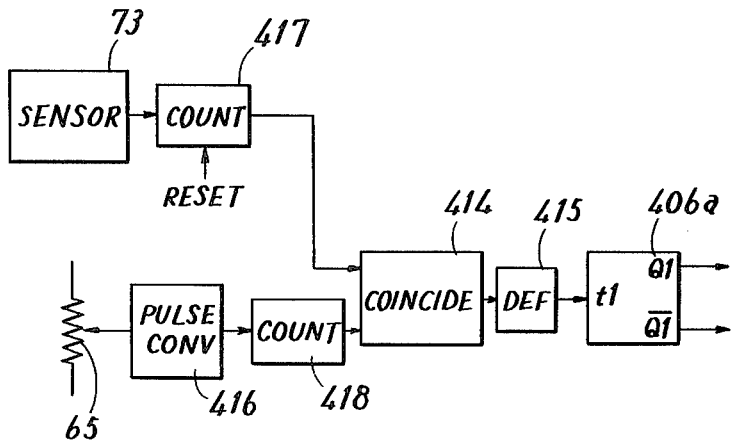
FIG. 11 is a block diagram showing still another embodiment of the present invention.

Referring to FIGS. 10 and 11, another embodiment of the present invention is illustrated. Although in the previously described embodiment, the button size setting and the fabric feed were accomplished through processing of the voltages in an analog system, the embodiment presently to be described utilizes a digital system for processing the signals.

Referring to FIG. 10, the embodiment illustrated is substantially the same as that shown in FIG. 2A except for certain modifications presently to be described. Accordingly, corresponding elements will not be described. The shoe 5 and the needle plate 23 are formed of non-magnetic material. The needle plate 23 carries a sensor 73 which is embedded in the needle plate so that its upper surface is flush with the surface of the needle, so as to provide a continuous surface on which the shoe 5 may slide. The sensor 73 may comprise a magnetic sensing device, such as a Hall effect device, a lead switch, or the like.

A magnetic strip 75 is mounted on the side wall of the shoe 5 proximate to the sensor 73. The strip 75 extends in the direction of the feed and is comprised of a plurality of magnets with poles of opposite polarity arranged at intervals of 0.3 to 0.5 mm. As the fabric is fed by the feeding means, the shoe 5 is moved in the directions of the arrows A or B and a pulse is generated by the sensor 73 for each magnetic pole of the magnetic strip 75. The embodiment illustrated utilizes these pulses and FIG. 11 shows a block diagram of said embodiment. Each pulse generated by the sensor 73 for each magnetic pole or the fabric feed pulse is applied to the input terminal of a counter 417. The count value in the counter 417 is applied to one input terminal of a comparator or a coincidence circuit 414. The analog voltage obtained from the sliding variable resistor 21 shown in FIGS. 2A and 2B relating to the buttonhole size is applied to a pulse converter 416. The pulse converter 416 provides a pulse train signal or a size pulse signal which includes the pulses of the number corresponding to the magnitude of the input voltage, which is applied to the input terminal of a counter 418. The count value of the counter 418 is applied to the other input terminal of the coincidence circuit 414. The counter 418 serves to retain the count value corresponding to a button size. The coincidence circuit 414 serves to compare the contents of the two counters 417 and 418 to provide a high level pulse when both coincide with each other. The output from the coincidence circuit 414 is applied to the differentiation circuit 415 for differentiating the rise of the pulse, and the differentiated output from the differentiation circuit 415 is applied to an input terminal t1 of a triggering flip-flop circuit 406*a*, as shown in FIG. 8A.

In operation, the button size is determined by adjusting the slide 29 of the variable resistor 27 mounted in the arm 1 to snugly engage the button 33. The voltage V1 associated with the particular button size is obtained from the variable resistor 27. The voltage V1 related to the button size, by means of the pulse converter 416, is obtained as a pulse train signal and includes pulses of the number associated with the signal. The pulses of the pulse train signal are counted by the counter 418 and the count value of the pulse number corresponding to the button size is obtained from the counter 418. One input terminal of the coincidence circuit 414 is supplied with the count value corresponding to the button size obtained from the counter 418. The counter 418 is reset to its initial state, as soon as the foot controller switch, not shown is initially activated. In the initial condition, the shoe 5 is moved to its extreme position in the direction of arrow A. At such time the flip-flop circuit 406*a* is reset and the output $\overline{Q1}$ is at high level. The mode $\overline{Q1}$ is established in response to the output $\overline{Q1}$. Accordingly, as hereinabove described, the bar tack portion BT1 and the left side portion SD1 of the buttonhole are stitched.

At the left side portion SD1 is stitched, the shoe 5 moves in the direction of arrow B and pulses are generated by the sensor 73 during such movement. The pulses generated by the sensor 73 are successively applied to the counter 417. The counter 417 is reset to its initial condition, as is also counter 418, simultaneously with the initial activation of the foot controller switch. The counter 417 counts the number of pulses from the sensor 73 and the count value in the counter 417 is applied to the other input terminal of the coincidence circuit 414. As the shoe 5 moves, the count values in the counters 417 and 418 come to coincide with each other and the coincidence output at a high level is obtained from the coincidence circuit 414. A differentiated pulse is obtained from the differentiation circuit 415 and is applied to the triggering input terminal t1 of the flip-flop circuit 406*a*. Accordingly, when the stitching operation of the left side portion SD1 of the buttonhole is completed, the inverted output Q1 of the flip-flop circuit 406*a* is at high level, while the non-inverted output $\overline{Q1}$ of the flip-flop circuit 406*a* is at low level. The mode Q1 thus is established and the bar tack portion BT2 and the right side portion SD2 of the buttonhole are stitched in the same manner, as described previously. At such time, the counter 417 is reset in response to the output Q1, so that the counter 417 now is ready for a subsequent stitching operation for the right side portion SD2 of the buttonhole.

Figure 12C:
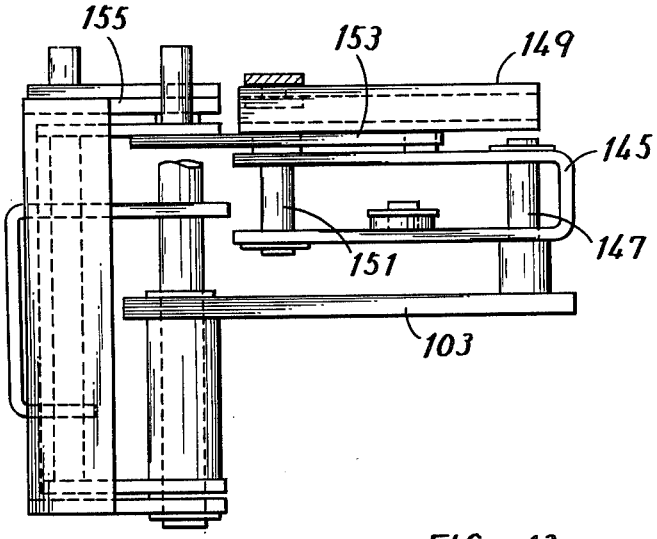
FIGS. 12A through 12C show the principal portion of another example of a buttonhole mechanism controlled according to the present invention.
Figure 12A:
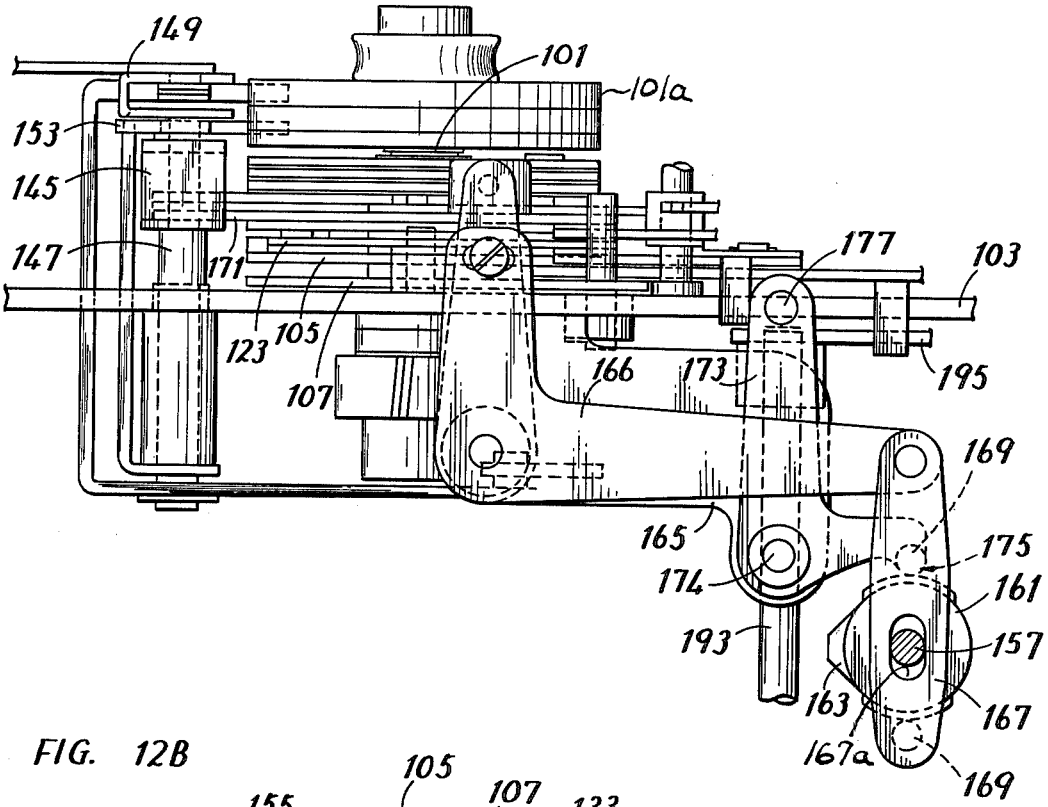
Figure 12B:
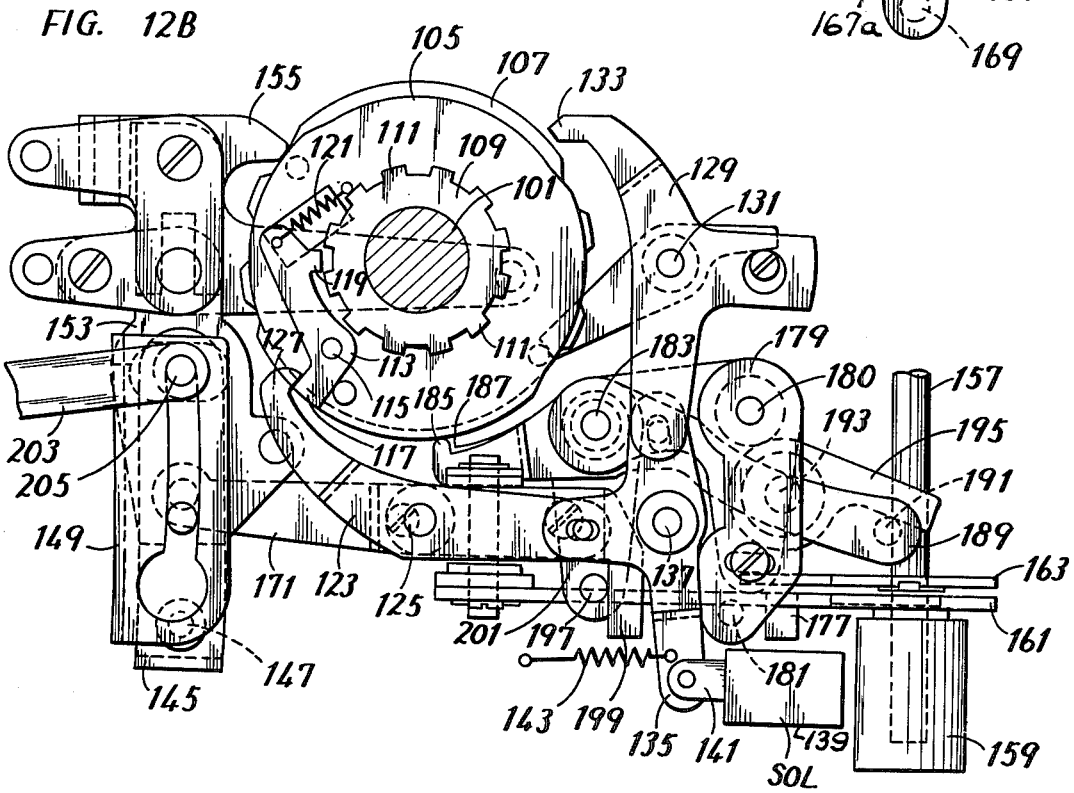

FIGS. 12A, 12B and 12C illustrate still another embodiment of a buttonhole mechanism which may be controlled by the present invention. FIG. 12A is a front view, FIG. 12B is a plan view, partly in cross-section, and FIG. 12C is a side view of the mechanism and related parts. Referring to FIGS. 12A through 12C, the numeral 101 indicates a vertical shaft rotatably mounted on a support member 103 within the sewing machine arm. The shaft 101 is driven by the upper drive shaft 35 inside the arm through speed reducing gearing so as to be rotated at a reduced speed. Stacked pattern cams 101*a* are mounted on the cam shaft 101 together with a buttonhole fabric feed cam 105 and a needle position control cam 107. The cams 105 and 107 are integrally joined in spaced relation, by a plurality of pins. Disposed above the fabric feed cam 105 and fixed on said cam shaft 101 is a toothed wheel 109 having a plurality of uniformly spaced teeth 111 formed on the outer periphery. A pawl 113 is pivotally supported on the upper surface of the feed cam 105 by a stud 115. The pawl 113 is formed with a lateral projection 117 at one end. The opposite end of the pawl 113 terminates in a projectiion 119 adapted to engage against the teeth 111 on the toothed wheel 109. A spring 121 biases the projection 119 into engagement with the teeth 111.

Pivotally mounted on a shaft 125 carried on the support 103 is an actuating lever 123 having a hook 127 formed at the front end thereof and adapted to engage the projection 117. Similarly, pivotally mounted on a shaft 131 carried on support 103 is an actuating lever 129 having an end projection 133 which will abut against the projection 117 when the cam 105 is rotated. The opposite ends of the levers 123 and 129 are connected, by elongated slots and pin means, to respective arms of an operating crank member 135 pivotally mounted intermediate its ends on a shaft 137 carried on the support 103. One end of the crank member 135 is pivotally connected to one end of an actuating lever 141 of a solenoid 139 mounted with the machine arm 1. The crank member 135 is biased in a clockwise direction, as viewed in FIG. 12B by spring 143, one end of which is hooked within the sewing machine arm. As shown in FIG. 12C, a V-shaped arm 145 is pivotally mounted on a shaft 147 fixed in support 103. An oscillating member 149 is pivotally supported on a pin 151 mounted at the distal end of the arm 149.

Referring to FIG. 12A, the numeral 157 indicates a switching shaft rotatably supported in the front wall of the sewing machine arm 1. The shaft 157 has a knob 159 fixed to its forward end and also carries fixed cams 161 and 163. A mounting member 165 integral with the support 103 carries a crank lever 166 pivotally supported to the left of the shaft 157, as viewed in FIG. 12A. The horizontal arm of the crank lever 166 is pivotally connected to the upper end of a lifting lever 167. The lifting lever 167 has a central longitudinally elongated hole 167*a* in which the shaft 157 is loosely fitted. A pair of pins 169 are fixed in the lever 167 in spaced relation to opposite ends of hole 167*a*. When a reset position for not sewing buttonholes is selected, the high points on the periphery of the cam 161 engage the upper and lower pins 169 to lock the lifting lever 167 and when a set position for sewing buttonholes is selected, the cam 161 is rotated to effect registry of the low points of the cam with the pins 169 thereby providing a clearance between the pins 169 and cam 161 to permit the upward and downward movement of the lifting lever 167. A lever 171 is connected at one end to the vertical leg of a crank lever 166, with the opposite end of the lever 171 being connected to the movable arm 145, so that longitudinal movement in either direction of the lever 171 causes the arm 145 to swing to the right and left, as viewed in FIG. 12B, about the axis of shaft 147, thereby changing the base line. A lever 173 is pivotably supported at its lower end on a shaft 174 fixed on mounting member 165. The lever 173 includes a lower lateral extension terminating in a follower portion 175 which is in register with the cam 163, so that when the shaft 157 is brought to a set position, the high part of cam 163 will engage the follower 175 to rock the lever 173 counterclockwise, as viewed in FIG. 12A, and when the shaft 157 is brought to the reset position, the high point of cam 163 is spaced from the follower 175. Further, the upper end of the lever 173 has a forwardly directed pin 177 fixed thereon which is adapted to contact with the right side of a downwardly directed pin 181 provided at the front end of a member 179. The switching member 179 is pivotally mounted on a shaft 180 fixed on support 103. A pair of cam followers 185 and 187 are independently pivotally mounted on a pin 83 carried on switching member 179. The followers 185 and 187 are adapted to contact the feed cam 105 and needle position cam 187, respectively. A pin 191 depends from the end of arm 189 which is an extension of cam follower 185 and is adapted to contact a member 195 rotatably supported on the upper end of an elongated shaft 193 fixedly mounted within the sewing machine arm. The shaft 193 is provided with a conventional feed regulator mechanism connected to the upper end thereof for controlling the amount of fabric feed. The angle of rotation of the shaft 193 controls the position of the feed regulator to provide a desired amount of fabric feed. An arm 201 integral with cam follower 187 is provided at its end with a depending pin 197 which is adapted to engage an arm 199 integral with lever 171.

The operation of the above described mechanism in a buttonhole sewing operation follows.

Figure 14A:
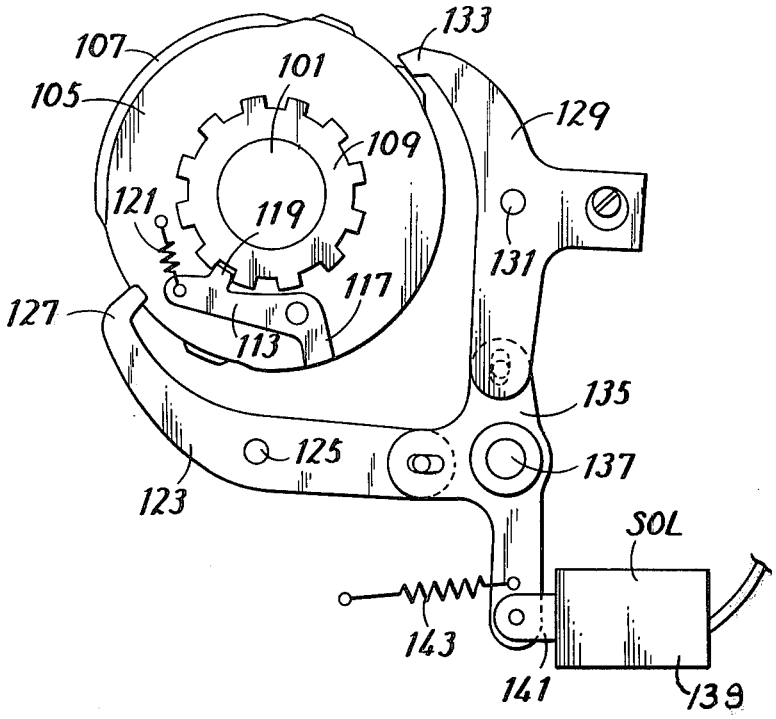
Figure 14B:
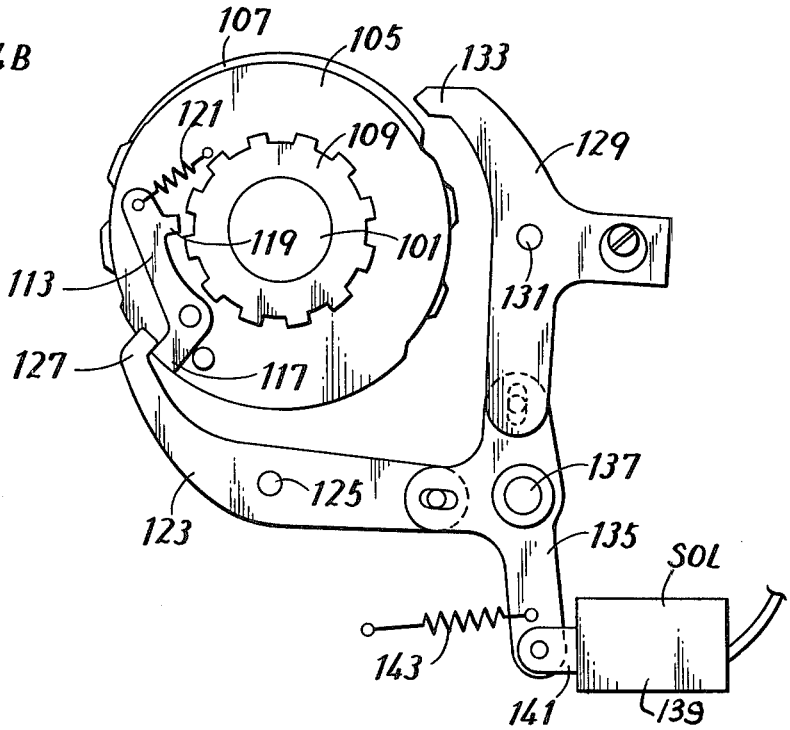
Figure 14C:
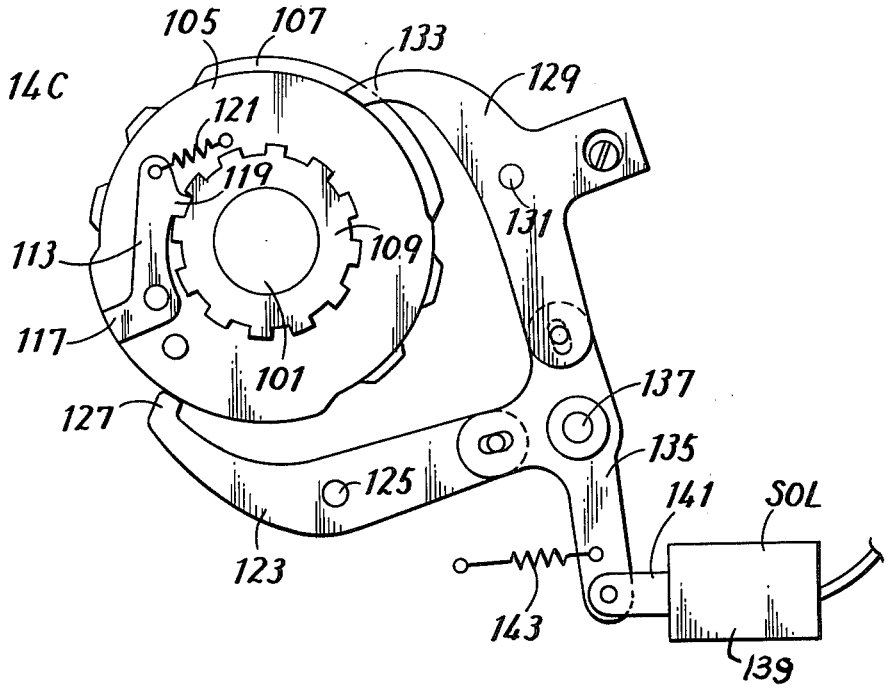
Figure 14D:
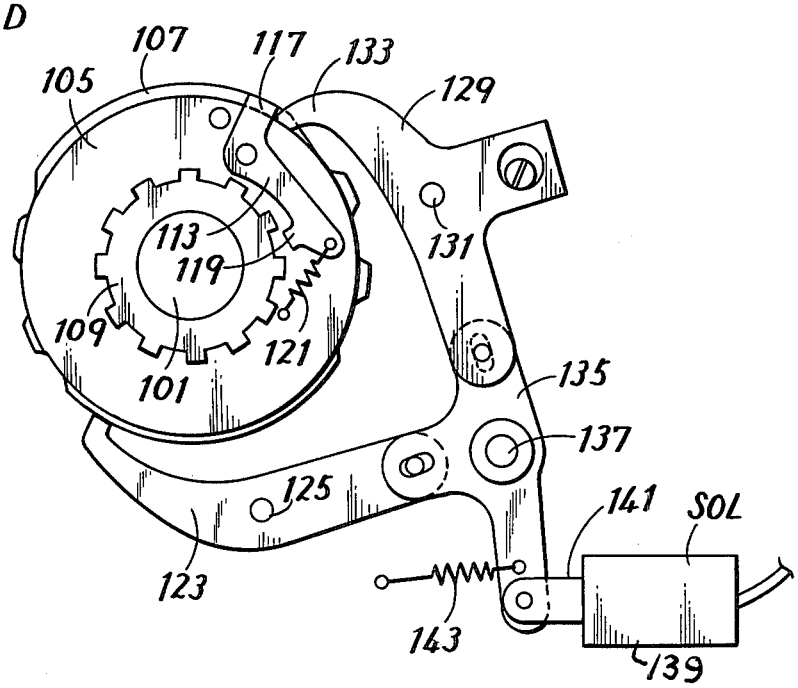

For the sewing of a buttonhole, the shaft 157 is rotated with the knob 159 to rotate the cams 161 and 173 clockwise through 90°, from the position shown in FIG. 12A. In this condition, the high points of the cam 161 are spaced from the upper and lower pins 169, and the lifting lever 167 and the crank lever 166 are freed. At the same time, the follower 175 is engaged by the cam 163, and the lever 173 is rotated in a counterclockwise direction, as viewed in FIG. 12A, so that the pin 177 engages pin 181 urging the switching member 179 to the left, as viewed in FIG. 12B, to bring the cam followers 185 and 187 into engagement with the peripheries of the cams 105 and 107, respectively. In order to obtain the amplitude corresponding to the buttonhole stitching width l shown in FIG. 1, a zigzag width control, not shown, is adjusted so that the pin 205 of the connecting lever 203 is positioned at a prescribed location in the elongated aperture of the oscillating member 149. Thus, the positional relationship between the buttonhole cams 105 and 107, pawl 113 and actuating levers 123, and 129 are as shown in FIG. 14D which is established upon completion of the preceding buttonhole. The foot operated control is then depressed to effect rotation of the motor and energization of solenoid 139, as will be hereinafter described. The actuating lever 141 of the solenoid lever 139 is drawn in, rocking the crank member 135 counter-clockwise, as viewed in FIG. 12B against the resistance of the spring 143. The hook 127 of lever 123 is moved out of the path of revolution of pawl 113 while lever 129 is moved to retracted position. Thus, pawl 113 is urged by spring 121 to the position wherein the tooth 119 is received in a space between adjacent teeth 111, thereby interlocking cams 105 and 107 for rotation with shaft 101. The cam follower 185 is rocked to a neutral position relative to feed cam 105, bringing the feed regulator, not shown, to its neutral position, i.e. zero feed position. Further, the cam follower 187 is rocked by the needle position control cam 107. With pin 197 engaging arm 199, lever 171 is moved to right and left position, as viewed in FIG. 12B. This effects corresponding rocking movement of arm 145 which results in right and left movement of the needle. Thus, with the feed at zero, the bar tack BT1 of the buttonhole shown in FIG. 1 is stitched.

When the feed cam 105 and needle position control cam 107 are rotated through half a revolution, as the bar tack BT1 is sewn, the projection 117 of the pawl 113 is engaged by the hook 127 of lever 123, so that the tooth 119 of the pawl 113 is disengaged from the toothed wheel 109 and the two cams 105 and 107 are freed from the cam shaft 101 and are arrested. At this time, feed cam 105 urges the cam follower 185 out of its neutral position, with the pin 191 of the arm 189 rotating the member 195 at the upper end of the elongated shaft 193 in a counterclockwise direction, as viewed in FIG. 12B, so that the feed regulator, not shown, at the lower end of the elongated shaft 193 is rocked counter-clockwise from the neutral position. Accordingly, the fabric feed advances at an adjusted rate. The needle position control cam 107 now positions the cam follower 187 for a left base line; that is, pin 197 on the arm 201, at the left needle position, engages the arm 199 of the connecting lever 171 which is urged to the left by a spring, not shown. The arm 145 now is adjusted for the left needle position and the left side SD1 of the buttonhole BH in FIG. 1 is stitched in a forward direction with a predetermined stitch width.

When the left side SD1 has been stitched through length L, the solenoid 139 is deenergized, as will be hereinafter described, permitting spring 143 to rock the crank member 135 clockwise and the actuating lever 123 counterclockwise, as viewed in FIG. 12B. Accordingly, the hook 127 is disengaged from the projection 117 and pawl 113 is rocked by spring 121 to engage the tooth 119 in a space between adjacent teeth 111. Thus, cams 105 and 107 are locked for rotation with the shaft 101 so that the bar tack BT2 now is stitched in the same manner as the bar tack BT1 in FIG. 1, previously described.

As the bar tack BT2 is stitched, the feed cam 105 and needle position control cam 107 are rotated through half a revolution. At such point, the projection 133 of the lever 129 because of the previous deenergization of the solenoid 139 now abuts against the projection 117 of the pawl 113 on cam 105. Accordingly, the tooth 119 of the pawl 113 is disengaged from the toothed wheel 109 and the two cams 105 and 107 are freed from rotation with the cam shaft 101 and come to rest. The feed cam 105 now positions the cam follower 185 for the backward stitching with the same longitudinal feed position as the left side SD1 of the buttonhole. Further, the needle position control cam 107 moves the cam follower 187 further outwardly, moving the lever 171 to the right, as viewed in FIG. 12B, and placing the arm 145 for the right side needle position. By operating the sewing machine in this manner, the right side SD2 of the buttonhole BH illustrated in FIG. 1 is stitched in a backward direction. The stitching and bar-tacking of the buttonhole BH shown in FIG. 1 are completed, as above described.

The operation will now be described in greater detail with reference to the block diagram shown in FIG. 13 and the mode condition diagram shown in FIG. 14D.

Before entering into a description of the preferred embodiment of the present invention, the block diagram shown in FIG. 13 will first be described. The output $\overline{Q1}$ from the flip-flop circuit 406*a*, as shown in FIGS. 8A, 9 and 11, is applied as an on/off input to the switching circuit 409 of the motor M. The switching circuit 409 is comprised of thyristors and is so designed that it is unconditionally activated, in the initial state, when the switch 421 for the foot control, not shown, serving as speed control means, is activated and it is deactivated when the output $\overline{Q1}$ has changed to a high lever. In addition, when the foot control switch 421 is activated, the motor power source 420 and solenoid power source 422 are activated.

Further, the output Q1 from the flip-flop circuit 406*a* is delivered as an on/off input to the switching circuit 423 for the solenoid 139 and the switching circuit 424 for resetting purposes. The switching circuit 423 is comprised of thyristors and is so designed that it is unconditionally activated, in the initial state, when the foot control switch 421 is activated, and it is deactivated when the output Q1 has changed to a low level. Once deactivated, the switching circuit 424 will never become activated irrespective of the output Q1, unless the switch 421 is again activated in the initial state. The switching circuit 424 is comprised of thyristors and so designed that it is off in the initial state when the foot control switch 421 is activated, that it is activated only when the output Q1 has changed from a high level to a low level, and that it will never turn on unless the foot control switch 421 again is activated in the initial state.

The operation will be described in detail. In this embodiment, it is to be understood that the bar tack BT1, left side SD1, bar tack BT2 and right side SD2 of the buttonhole BH shown in FIG. 1 will be stitched in the order mentioned. First, the knob 159 is manipulated to activate the buttonhole mechanism and then the button size is determined by means of the sliding knob 29 of the variable resistor mounted in arm 1. Further, in the initial state, the shoe 5 for fabric feed is set by pulling it forwardly all the way, in the direction of arrow A in FIGS. 2A or 10.

The foot control pedal (not shown) is depressed, whereupon switch 421 is activated. In response thereto, the two switching circuits 419 and 423 are activated in the initial state. The motor circuit M is energized with a current of a predetermined conduction angle from the motor power source 420 and the solenoid 139 is energized by the solenoid power source 422. As a result, the actuating lever 141 of the solenoid 139 is drawn in, thus rocking the crank member 135 clockwise against the tension of the spring 143, as shown in FIG. 14A. The hook 127 of the lever 123 moves towards feed cam 105, the end projection 133 of the lever 129 moves away from the feed cam 105, and the projection 119 of pawl 113 is engaged with toothed wheel 109 so that shaft 101 and cams 105 and 107 are locked for rotation. As previously described, the bar tack BT1 shown in FIG. 1 is stitched. As the bar tack BT1 is stitched, the feed cam 105 and needle position control cam 107 are rotated and, as shown in FIG. 14B, the hook 127 of the actuating lever 123 abuts against the projection 117 of the pawl 113, effecting disengagement of the projection 119 from wheel 109. In response thereto, the cams 105 and 107 are arrested and, as previously described, the left side SD1 in FIG. 1 is stitched.

As said left side SD1 is stitched, the shoe 5 is moved in the direction of arrow B. Upon completion of the stitching of the left side SD1, the output $\overline{Q1}$ from the flip-flop circuit 406*a* changes to a low level and the output Q1 therefrom changes to a high level. The switching circuit 423 is deactivated and the switching circuit 424 is activated. As a result, the current from the solenoid power source 422 to the solenoid 139 is interrupted, so that the solenoid 139 is deenergized. As shown in FIG. 14C, the actuating lever 141 of the solenoid 139 is released and the crank member 135 is drawn to the left by spring 143. The hook 127 of the actuating lever 123 is retracted from cam 105 and projection 133 of actuating lever 129 is moved towards cam 105. In this condition, as previously described, the bar tack BT2 in FIG. 1 is stitched. Thereafter, cams 105 and 107 are rotated and, as shown in FIG. 14D, the projection 133 of the actuating lever 129 abuts against the projection 117 of the pawl 113. As a result, the projection 119 is disengaged from the toothed wheel 109, so that the cams 105 and 107 are now freed from shaft 101 and are arrested. In this condition, as previously described, the right side SD2 of the buttonhole shown in FIG. 1 is stitched. As the right side SD2 is stitched, the shoe 5 is moved through length L in the direction of arrow A in FIG. 2A. The flip-flop circuit 406*a*, whose output $\overline{Q1}$ and inverted output Q1 have been changed to the low and high levels, respectively, by the differentiation pulses obtained previously upon completion of the stitching of the left side SD1, responds to differentiation pulses obtained by the stitching of the right side SD2 and its outputs $\overline{Q1}$ and Q1 change to high and low levels, respectively. Accordingly, the power source for the motor M is cut off, thus deenergizing the motor M. In this manner, stitching of the buttonhole BH is automatically effected, and the operator releases the foot pedal to end the operation and to deactivate the switch 421 in preparation for the next stitching operation.

Figure 13:
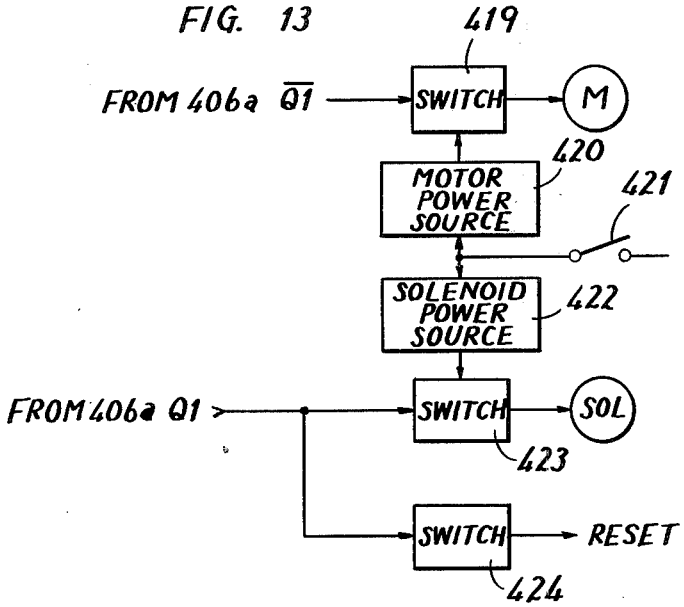
FIG. 13 is a block diagram showing a preferred embodiment of the present invention for controlling the mechanism shown in FIGS. 12A through 12C.

It will be understood that while the switching circuits shown in FIGS. 8B and 13 have been described as being comprised of thyristors, any other suitable devices may also be used so long as they are capable of holding the state.

UNITED STATES PATENT OFFICE

CERTIFICATE OF CORRECTION

PATENT NO. : 4,182,249

DATED : January 8, 1980

INVENTOR(S) : NOBUYOSHI MATSUMURA and KOTOHIKO TUKIOTA

It is certified that error appears in the above-identified patent and that said Letters Patent are hereby corrected as shown below:

On the heading page, the name of the inventor is misspelled. The correct name is NOBUYOSHI MATSUMURA.

IN THE SPECIFICATION

Col.8, line 30, Ql should be $\overline{Ql}$
Col.8, line 31, Ql should be $\overline{Ql}$
Col.9, line 56, 22 should be 27
Col.15, line 60, At should be As Signed and Sealed this

*Twenty-seventh* Day of *May 1980*

[SEAL]

*Attest:*

SIDNEY A. DIAMOND

*Attesting Officer* *Commissioner of Patents and Trademarks*

UNITED STATES PATENT OFFICE

CERTIFICATE OF CORRECTION

PATENT NO. : 4,182,249

DATED : January 8, 1980

INVENTOR(S) : NOBUYOSHI MATSUMURA and KOTOHIKO TUKIOTA

It is certified that error appears in the above-identified patent and that said Letters Patent are hereby corrected as shown below:

On the heading page, the name of the inventor is misspelled. The correct name is NOBUYOSHI MATSUMURA.

IN THE SPECIFICATION

Col.8, line 30, Q1 should be $\overline{Q1}$
Col.8, line 31, Q1 should be $\overline{Q1}$
Col.9, line 56, 22 should be 27
Col.15, line 60, At should be As Signed and Sealed this

*Twenty-seventh* Day of *May 1980*

[SEAL]

*Attest:*

SIDNEY A. DIAMOND

*Attesting Officer*

*Commissioner of Patents and Trademarks*